US006832845B1

(12) United States Patent
Kretzschmar et al.

(10) Patent No.: US 6,832,845 B1
(45) Date of Patent: Dec. 21, 2004

(54) CONTOUR LIGHT PROJECTOR

(75) Inventors: Thomas E. Kretzschmar, 107 Cherrywood St., Bellaire, TX (US) 77401; Gilbert Thomas Pistole, Katy, TX (US)

(73) Assignee: Thomas E. Kretzschmar, Bellaire, TX (US)

( * ) Notice: Subject to any disclaimer, the term of this patent is extended or adjusted under 35 U.S.C. 154(b) by 188 days.

(21) Appl. No.: 09/881,154

(22) Filed: Jun. 14, 2001

(51) Int. Cl.[7] ..... F21V 17/00

(52) U.S. Cl. ..... 362/277; 362/268; 362/321; 362/320

(58) Field of Search ..... 362/268, 321, 362/364, 371, 362, 365, 368, 370, 549, 548, 320

(56) References Cited

U.S. PATENT DOCUMENTS

| | | | | |
|---|---|---|---|---|
| 2,210,391 | A | | 8/1940 | Wendel |
| 2,354,237 | A | | 7/1944 | Wendel |
| 2,481,054 | A | | 9/1949 | Wendel |
| 3,984,849 | A | | 10/1976 | Guillaume |
| 4,110,036 | A | * | 8/1978 | Guillaume ..... 355/32 |
| 4,210,955 | A | * | 7/1980 | Labrim ..... 362/321 |
| 4,217,047 | A | | 8/1980 | Jacksen et al. |
| 4,468,720 | A | * | 8/1984 | Arai ..... 362/281 |
| 4,636,925 | A | * | 1/1987 | Kristofek ..... 362/277 |
| 5,957,572 | A | | 9/1999 | Wedekind et al. |
| 5,980,066 | A | | 11/1999 | Belliveau et al. |
| 6,048,080 | A | | 4/2000 | Belliveau |
| 6,048,081 | A | | 4/2000 | Richardson |
| 6,089,732 | A | | 7/2000 | Wright et al. |
| 6,092,914 | A | * | 7/2000 | Esakoff et al. ..... 362/268 |
| 6,206,544 | B1 | * | 3/2001 | Costa ..... 362/242 |
| 6,241,366 | B1 | * | 6/2001 | Roman et al. ..... 362/293 |
| 6,244,730 | B1 | * | 6/2001 | Goldberg et al. ..... 362/268 |

OTHER PUBLICATIONS

"Selecon architectural display lighting" brochure of Selecon New Zealand Ltd., Auckland, New Zealand, 16 pages including the front cover and the back cover, no discernable date of publication.

"SELECON Architectural Products The Accent range The Solon Recessed Mounting" promotional page obtained from the Selecon Internet site Sep. 10, 2001.

"Accent spot" and "solon recessed mounting" 2 specification pages obtained from the Selecon Internet site Sep. 10, 2001, with a reference to Apr. 1997.

"SELECON Architectural Products The Accent range The Accent Profile" promotional page obtained from the Selecon Internet site Sep. 10, 2001.

"Accent profile" 2 specification pages obtained from the Selecon Internet site Sep. 10, 2001, with a reference to Apr. 1997.

"WENDELIGHTING Model 1180 Optical Projector Track Lighting System" flier of WENDELIGHTING Division of Jacksen International Ltd., 2 pages, prior to May 2000.

"WENDELIGHTING Model 2350 Optical Projector Track Lighting System" flier of WENDELIGHTING Division of Jacksen International Ltd., 2 pages, prior to May 2000.

"WENDELIGHTING Model 4100 Low–voltage Single Lens Floodlight" flier of WENDELIGHTING Division of Jacksen International Ltd., 1 page, prior to May 2000.

(List continued on next page.)

*Primary Examiner*—Alan Cariaso
*Assistant Examiner*—Anabel Ton
(74) *Attorney, Agent, or Firm*—E. Richard Zamecki

(57) ABSTRACT

Disclosed are a contour light projector including an optical bench for mounting optical components, a mounting assembly that includes a dual pivot system for increased versatility in directing a light projector mounted thereon, improved masking devices for the light projector, and lighting system housings for a variety of installations.

21 Claims, 23 Drawing Sheets

OTHER PUBLICATIONS

"WENDELIGHTING Fixture Can Accessories" bi–fold flier of WENDELIGHTING Division of Jacksen International Ltd., 4 pages, prior to May 2000.

"WENDELIGHTING Installation Instructions for Recessed Optical Projectors" booklet of WENDELIGHTING Division of Jacksen International Ltd., 21 pages, prior to May 2000.

"WENDELIGHTING® Recessed Optical Contour Projectors Models 1176 and 2346" tri–fold flier of WENDE LIGHTING® Division of Jacksen International Ltd., 6 pages, prior to May 2000.

"WENDELIGHTING Model 2346 Recessed Optical Projectors" flier of WENDELIGHTING Division of Jacksen International Ltd., 2 pages, prior to May 2000.

"WENDELIGHTING Model 2345 Optical Projectors" flier of WENDELIGHTING Division of Jacksen International Ltd., 2 pages, prior to May 2000.

* cited by examiner

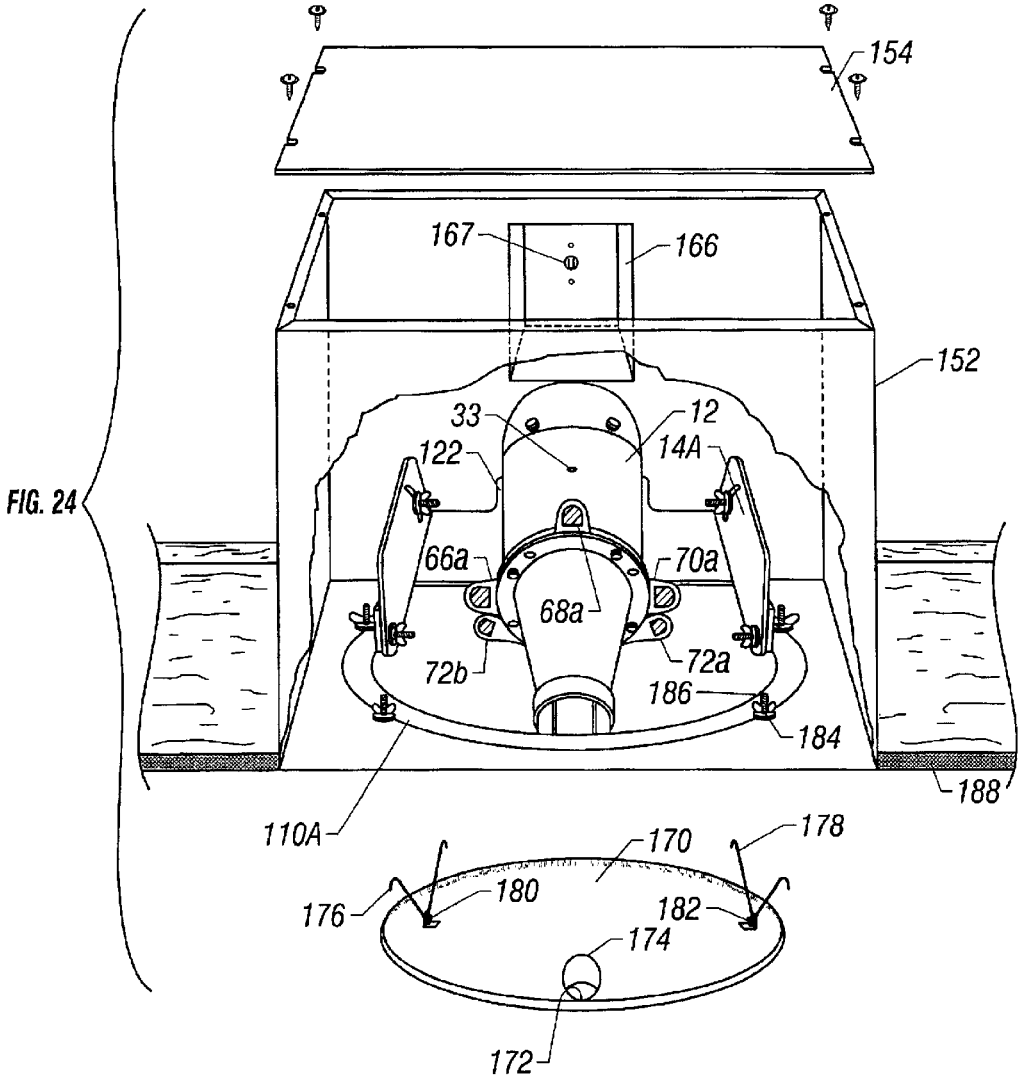
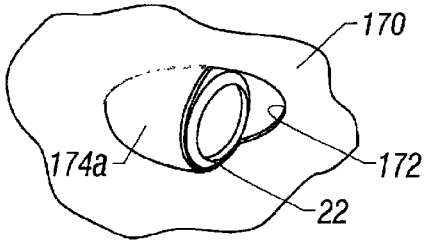
FIG. 26

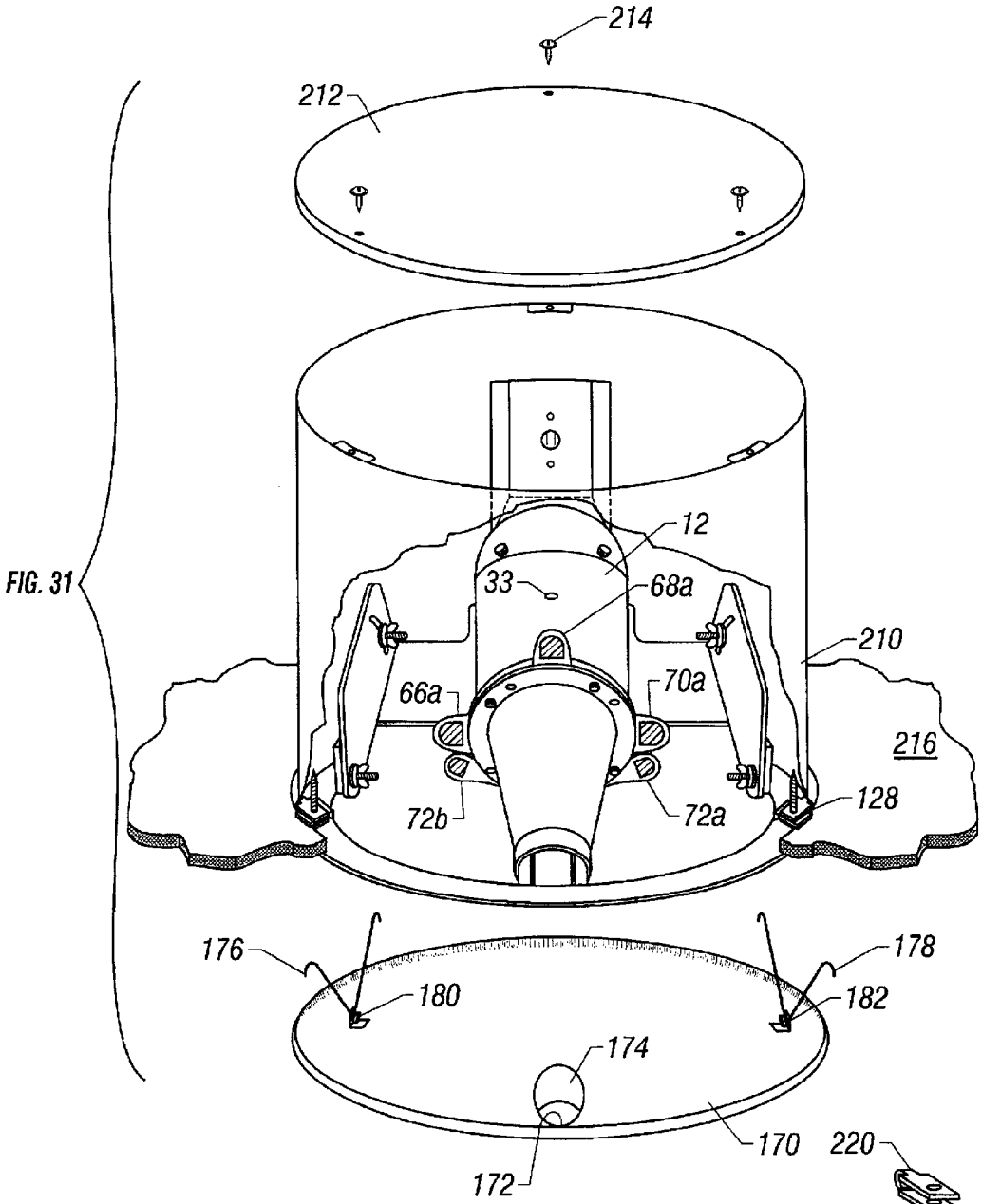
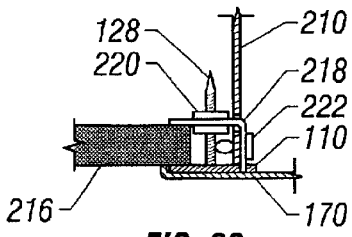
FIG. 33
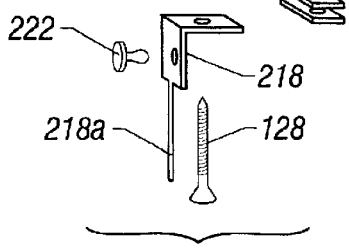
FIG. 32

CONTOUR LIGHT PROJECTOR

TECHNICAL FIELD

The present invention relates to light projectors that produce light beams for specialty lighting effects. More particularly, the present invention pertains to light projectors that can produce light beams of selected cross-sectional contours, or profiles, and apparatus for mounting and installing such projectors.

BACKGROUND OF THE INVENTION

Specialty light projectors are known for use in illuminating objects and scenes. Such light projectors may be used in lighting landscape features, architectural features, items displayed in cabinets or the like, art works, including pictures and sculpture, and scenes on a theatrical stage. Various techniques may be employed to affect a projected light beam, selectively blocking, or masking, a portion of the beam.

A mask, or masking device, is placed in the path of the light beam as a field stop, between condensing lenses and objective lenses, to define the cross-sectional profile of the light beam. A circular aperture may be used to define a circular profile for a projected light beam, but structured profiles may be achieved with more elaborate field stops, or masking devices, to produce desired specialty lighting effects. For example, a four-blade shutter is known for providing varied shapes defined by the straight edges of the blades. Such a shutter blade system typically has a handle, or tab, protruding from the outer edge of each blade so that the blades may be adjusted individually. However, when the only access to the light projector is from above, the tab of the bottom shutter blade may be inaccessible, and therefore adjustment of the light beam profile in that regard may be impractical, if not impossible. Also, one or more holes of any desired shape may be cut in a slide, or plate, which then serves as a masking device.

Additionally, a masking device may be made by using the light projector as a camera, with photosensitive material located where a masking device would be placed. With the light projector in its intended position relative to the target to be illuminated, the photosensitive material is exposed to light reflected from the target into the light projector. A negative photograph of the object to be illuminated by the projector, the target, is thus taken. U.S. Pat. No. 4,217,047 discloses apparatus for obtaining such a photograph. A photographic cassette or a self-developing film pack may be used. A photographic shutter may be added to the projector to control the entrance of light into the projector from the target. The photographic image of the target thus obtained is superimposed on a metal sheet and a hole is then cut in the sheet along the outline of the target image in the photograph. The metal sheet is then used as a mask, having an aperture that conforms in contour to the contour of the photographic image of the target. Alternatively, a metal sheet mask blank is painted and then coated with a photosensitive emulsion layer. The coated mask blank is used as film, which is then developed to obtain a photographic image of the target. An aperture stop may be used to control the amount of light that enters the projector from the target to expose the photosensitive emulsion. The metal sheet is then cut with a knife along the contour of the photographic image of the target to produce a masking device with an aperture that has the same contour as the target.

Contour light projectors may be installed in a variety of ways, depending on the environment and the manner of use.

For example, a light projector may be held on a bracket or the like, with the bracket fixed to a wall or other structure. A light projector may be installed above a ceiling to project a light beam down toward the floor, or at an angle toward an object or toward a portion of a wall. Generally, an above-the-ceiling installation involves locating the light projector within a housing that is placed above the level of the ceiling. Access from above the ceiling may or may not be available to install the housing and light projector, or to service the light projector after installation is completed. Further, the light projector must still be mounted within the housing, and the manner of so mounting the light projector will determine the limits of one's ability to direct the projected light beam, and to service the light projector in general.

It is advantageous and desirable to provide improved specialty lighting systems with mounting assemblies that include greater flexibility in mounting and directing light projectors, housings that are more adaptable to installation circumstances, masking devices that are easier to use and more effective, and light projectors with improved construction. The present invention provides contour lighting systems with a versatile mounting assembly, convenient and practical housings, improved masking devices, and improved light projector construction.

SUMMARY OF THE INVENTION

The present invention provides a lighting system including a contour light projector, masking devices for the light projector, a mounting assembly, and system housings for installation in various architectural settings. The mounting assembly includes a frame having an annular flange, and may also include a saddle having a cross member and a seat on which the light projector is selectively mounted, and a dual pivot system provided by the frame and the saddle whereby two pivot axes may be established such that the saddle may pivot about either axis relative to the frame to so orient the light projector. A light projector according to the present invention provides an optical bench within a housing assembly of the light projector on which one or more clamps are positioned to hold optical devices such as a lamp and a condensing lens of the projector. An improved shutter blade mask includes concave edges on the blades to define the contour of the light beam produced by the light projector, and a shutter blade that has two tabs, extending laterally from the blade rather than a single tab extending from the outer edge of the blade. Another mask comprises a glass plate having affixed thereto a photosensitized tape that is exposed to light and developed, and in which an opening is made to determine the contour of the light beam in the light projector. Lighting system housings include an enclosure that is closed on the bottom by a plate featuring a light projection hole, and spring hangers by which the plate is suspended.

BRIEF DESCRIPTION OF THE DRAWINGS

FIG. 24 is an exploded isometric view of the lighting system of FIG. 23, showing a light projector joined to the mounting assembly;

FIG. 26 is a fragmentary isometric view of a detail of a cover plate as shown in FIG. 25, with an alternative hood;

FIG. 31 is another exploded isometric view of the lighting system of FIGS. 18 and 30, showing the anchoring of the lighting system to the ceiling;

FIG. 32 is an enlarged, exploded view of a retaining clip and associated parts for use in anchoring the lighting system of FIGS. 18, 30 and 31 to a ceiling;

FIG. 33 is a fragmentary side elevation, in partial section, of a detail of the installed lighting system of FIGS. 18, 30 and 31, showing use of the retaining clip of FIG. 32;

DETAILED DESCRIPTION OF THE INVENTION

Figure 1:
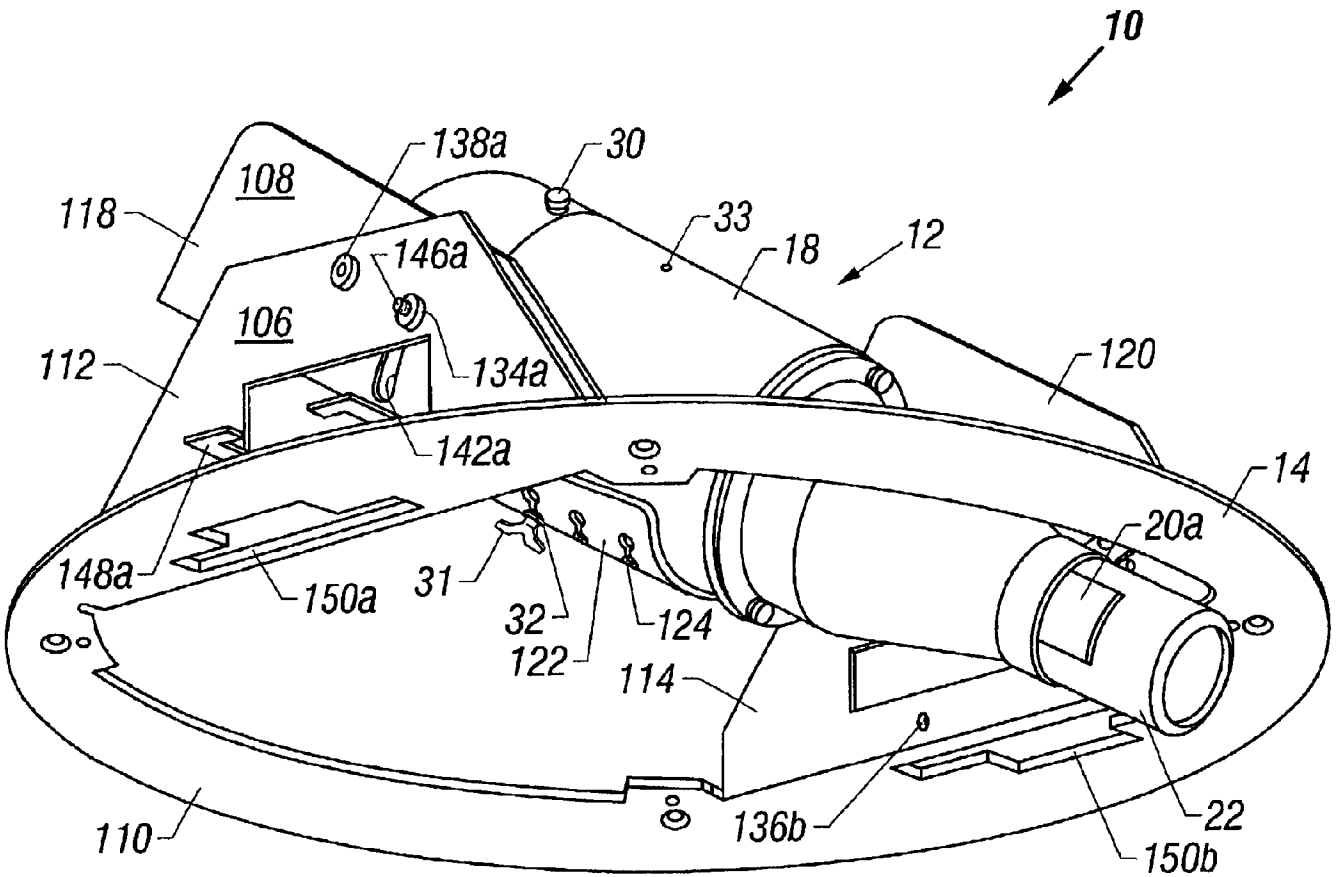
FIG. 1 is an isometric view of a light unit, including a contour light projector and a mounting assembly, according to the present invention.
Figure 2:
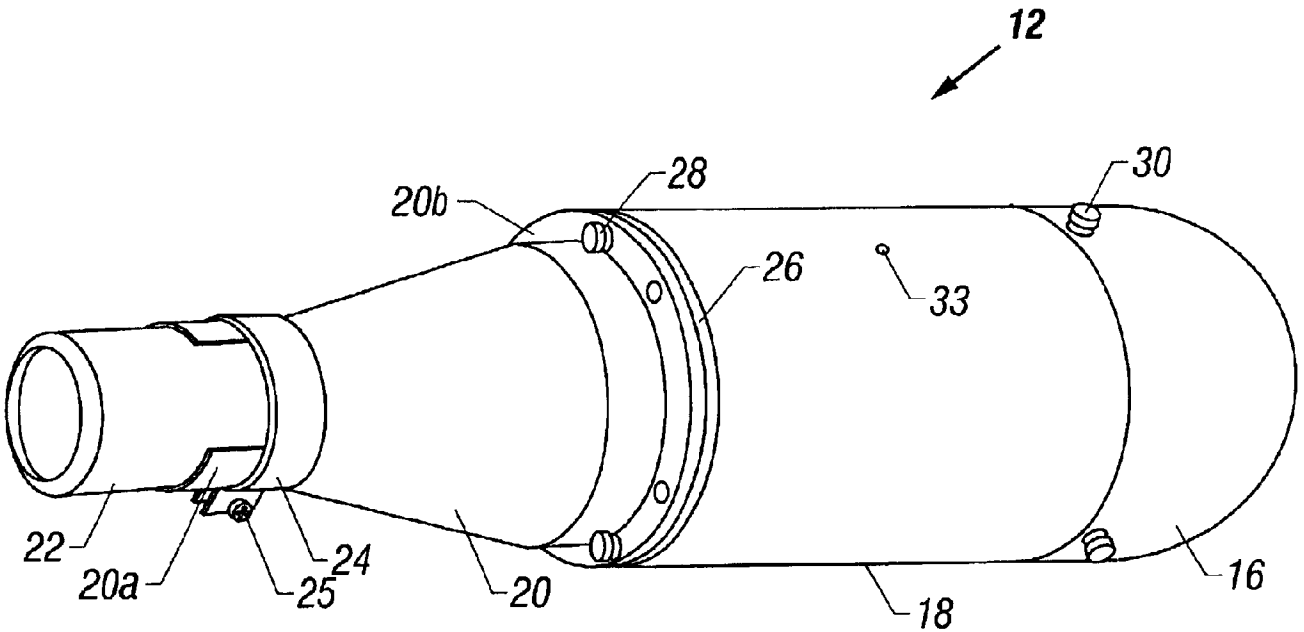
FIG. 2 is an isometric view of the light projector of FIG. 1.

A lighting system according to the present invention is illustrated and described in several presently preferred embodiments. A light unit according to the present invention is shown generally at 10 in FIG. 1, and includes a contour light projector 12 and a mounting assembly 14. The mounting assembly 14 is installed in various configurations as discussed below, and enables the light projector 12 to be positioned in a wide range of orientations, also as discussed below.

Details of the light projector 12 may be appreciated by reference to FIGS. 2–7. The light projector 12 features a housing assembly that includes an end cap 16, a main housing body 18, a reducing body 20 and a focal lens sleeve 22. The narrow end of the generally conical reducing body 20 has two extensions 20*a* that fit around the outside of the end of the sleeve 22. The sleeve 22 is then held to the reducing body 20 by a clamp 24 that is tightened down on the extensions 20*a* and on the sleeve, using a clamp screw 25. The sleeve 22 may be moved toward or away from the reducing body with the clamp 24 sufficiently loosened. A holding ring 26 is located between the wide end of the reducing body 20 and a seating surface 18*a* at the near end of the main housing body 18. A masking device is inserted between the holding ring 26 and the seating surface 18*a*, as discussed below. Bolts 28 pass through holes in a flange 20*b* at the wide end of the reducing body 20 and holes in the holding ring 26, and are threaded into holes in the seating surface 18*a* of the main housing body 18 to hold these three housing parts together. The end cap 16 is fitted over the opposite end of the main housing body 18 and held there by retaining bolts 30 that pass through appropriate holes in the end cap and are threaded into holes in the main housing body. Bolts 31 pass through washers 32 and are threaded into holes 33 in the main housing body 18 to use in attaching the projector 12 to mounting apparatus, such as the mounting assembly 14.

Optical devices are located within the housing of the projector 12. An optical bench 34 is provided in the form of an elongate metal base that has two parallel flat surfaces 34*a* and 34*b* that are different distances from the longitudinal axis of the bench. A clamp 36 is attached to the optical bench 34 at one flat surface 34*a*, and a second clamp 38 is attached to the bench at the second flat surface 34*b*. Nuts and bolts 40

Figure 3:
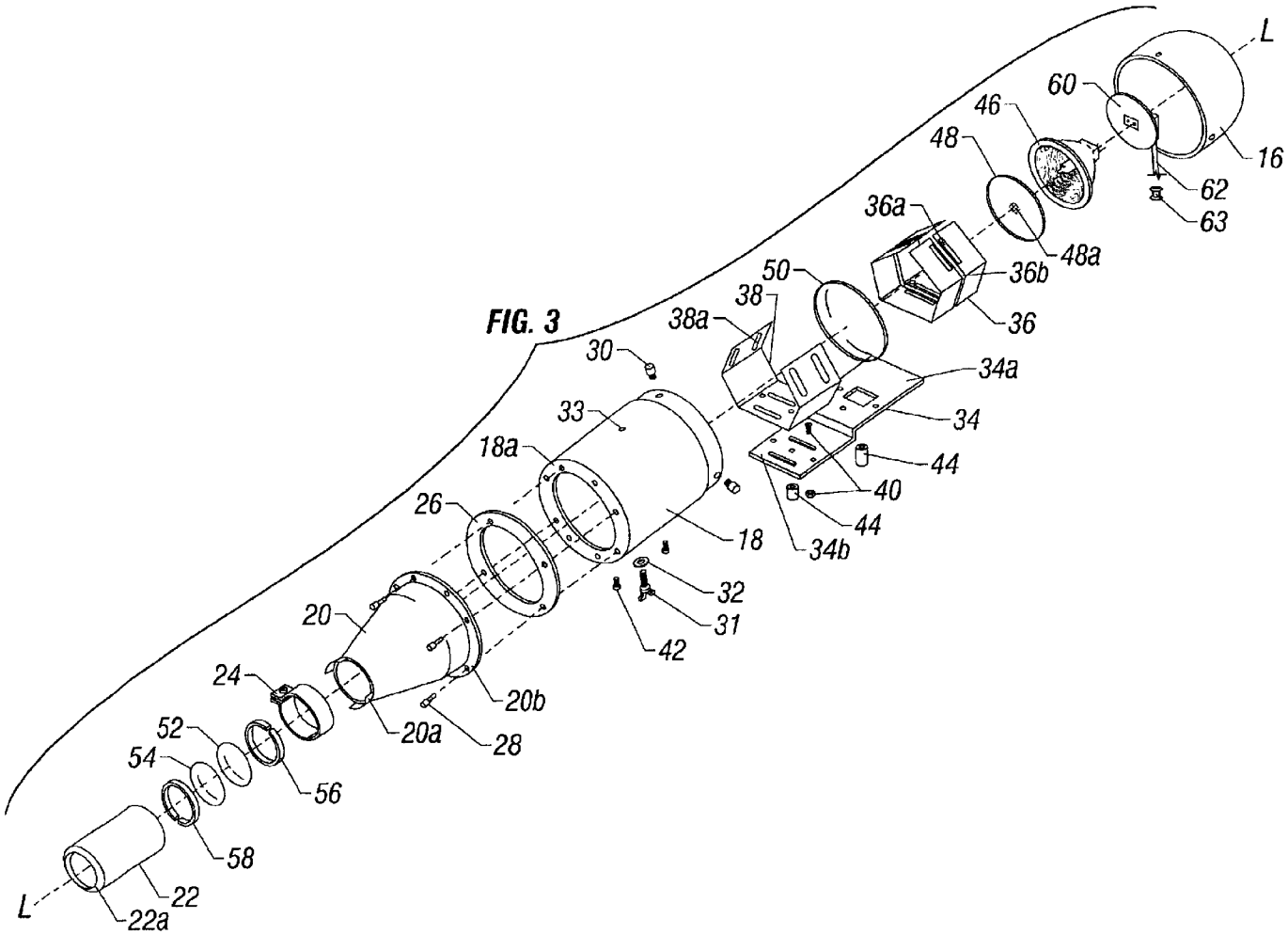
FIG. 3 is an exploded isometric view of the light projector of FIGS. 1 and 2.
Figure 4:
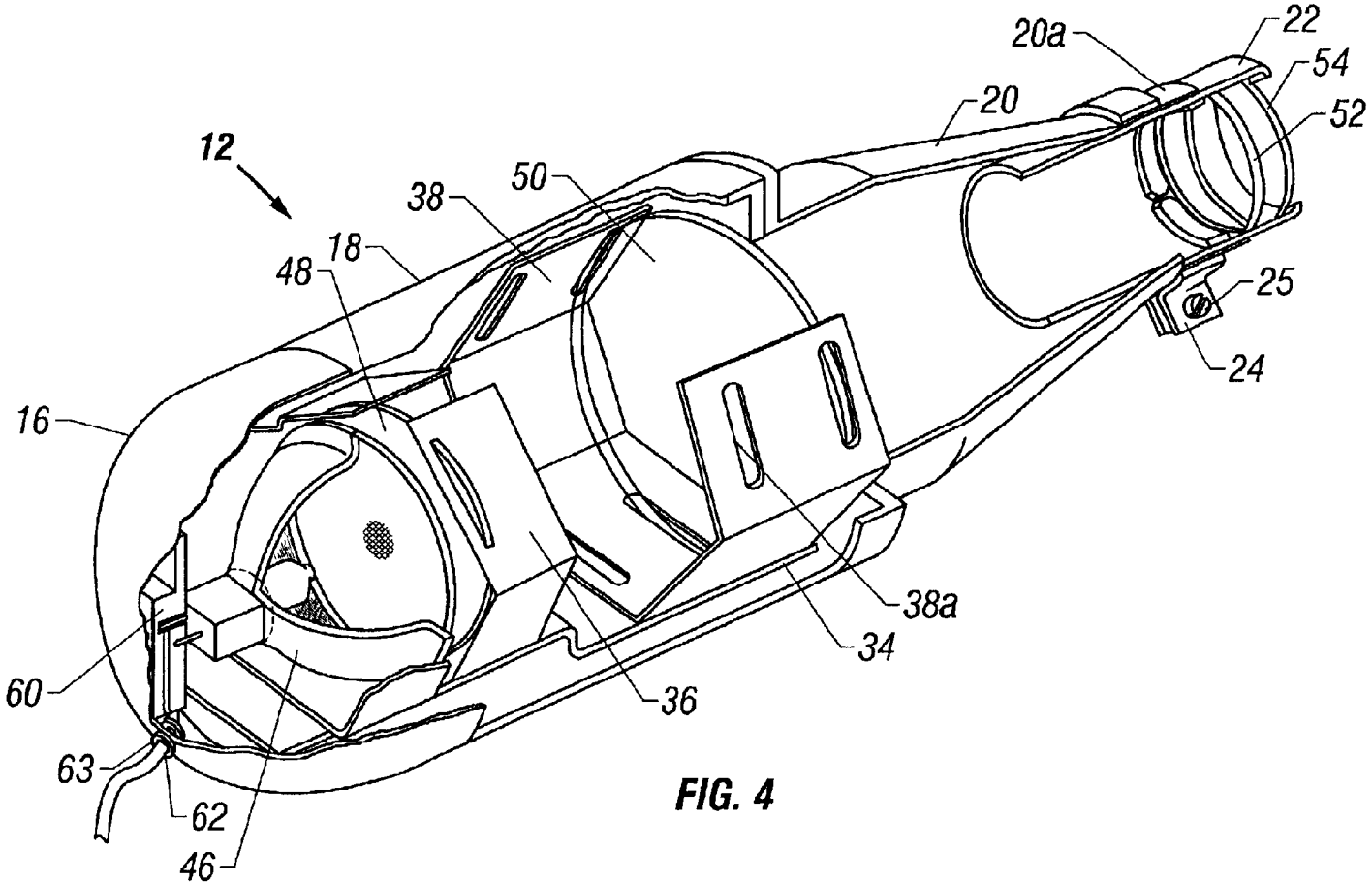
FIG. 4 is an isometric view, partially cut away, of the light projector of FIGS. 1–3.
Figure 5:
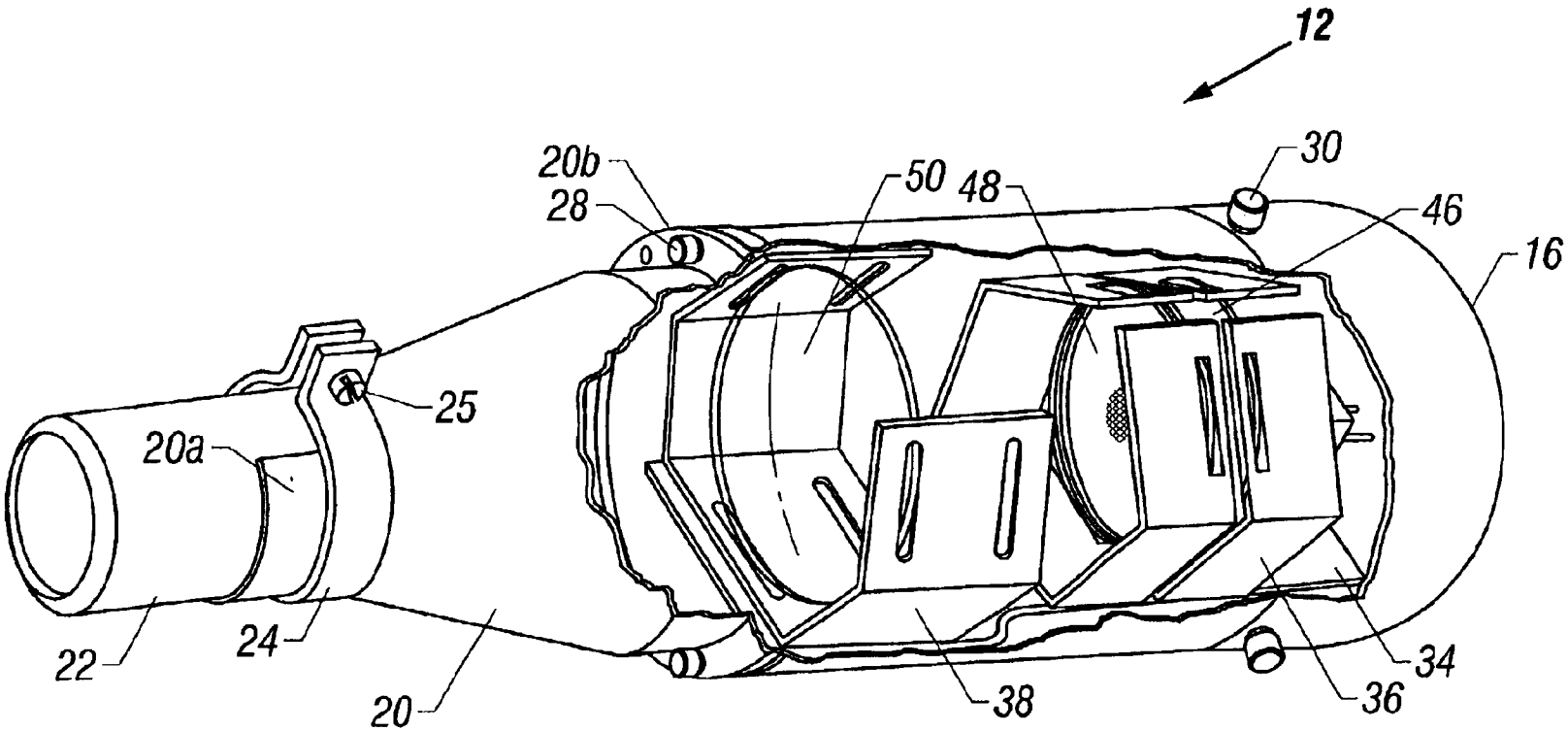
FIG. 5 is another isometric view, partially cut away, of the light projector of FIGS. 1–4.
Figure 6:
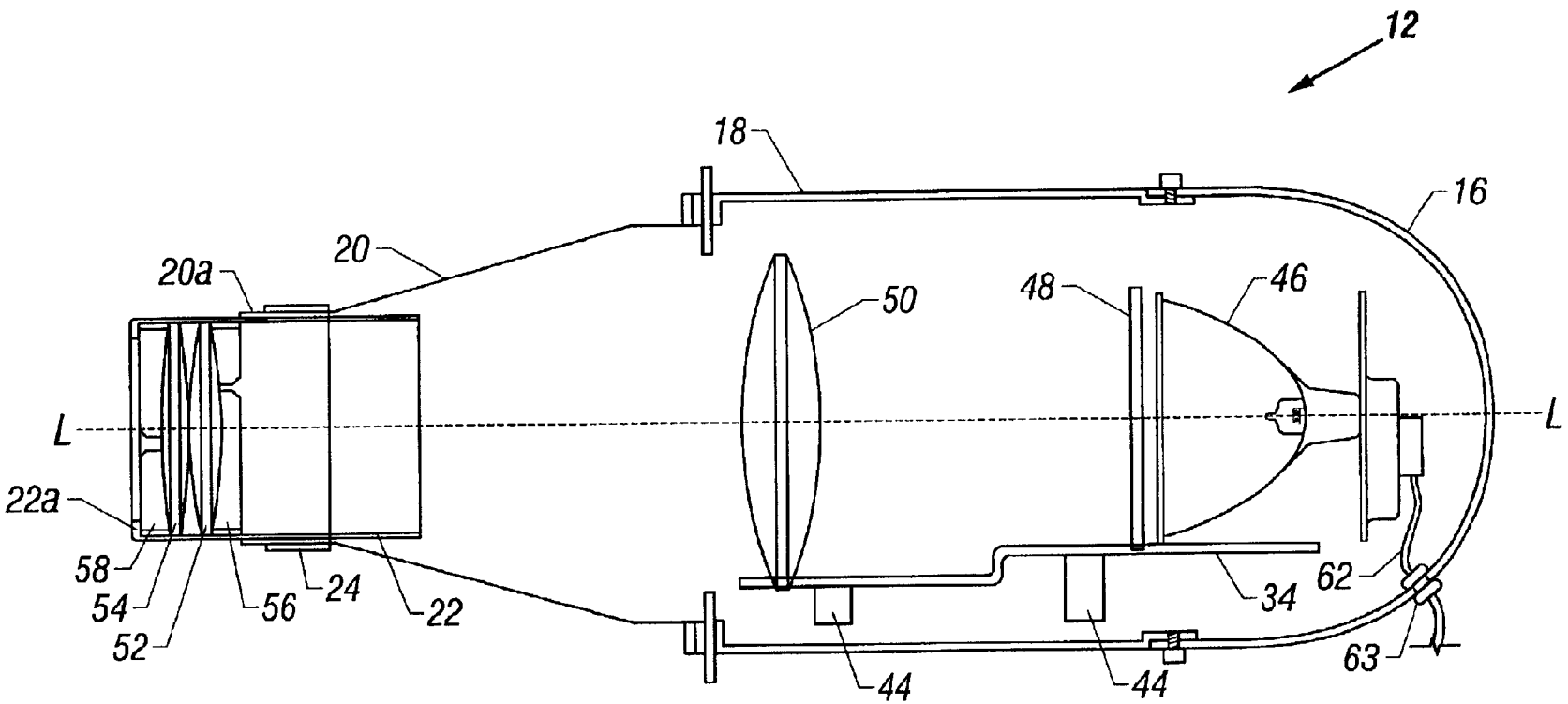
FIG. 6 is a side elevation in partial cross section, and partly schematic, of the light projector of FIGS. 1–5.

(one set is shown in FIG. 3) are used to attach the clamps 36 and 38 to the optical bench 34. Bolts 42 pass through the main housing body 18 and spacers 44, and are threaded into holes in the optical bench 34 to hold the bench in place within the light projector 12.

Each of the clamps 36 and 38 comprises a metal strip that is folded to form five planes. Openings in the form of slots 36*a* are located in the central plane and both end planes of the clamp 36. Openings in the form of slots 38*a* are located in the central plane and both end planes of the clamp 38. Three slots 36*a* are arranged in a plane perpendicular to the longitudinal axis of the optical bench 34 to receive a round optical device, such as a lamp 46. The folds of the clamp 36 are such that the lamp 46 may be forced into the slots 36*a* and be thereby held in place on the optical bench 34. A second set of three slots 36*a* define another plane perpendicular to the longitudinal axis of the optical bench and hold another optical device, namely, a diffusing filter 48. The clamp 36 has splits 36*b* to facilitate the placement of the two optical devices 46 and 48 within the slots in the folded planes. Two sets of three slots 38*a* each are similarly positioned in planes perpendicular to the longitudinal axis of the optical bench 34 to receive and hold optical devices. In particular, a double convex condensing lens 50 is held in one set of slots 38*a* of the clamp 38. All of the optical devices 46–50 are mutually aligned on the optical bench 34 to define a longitudinal axis for the array of these optical devices. The spacers 44 position the optical bench 34 within the main housing body 18 so that the longitudinal axis of the array of optical devices 46–50 within the light projector 12 passes along the longitudinal axis L—L of the projector housing assembly 16–26.

Additional optical devices are located in the focal lens sleeve 22. A first objective focal lens 52 and a second objective focal lens 54 are held in position within the sleeve 22 by two snap-ring spacers 56 and 58. Each of the projecting lenses 52 and 54 is a double convex lens. Other, alternative objective lenses may be used. For example, a single objective lens may be used, or up to four objective lenses may be included in the sleeve 22, depending on the focal lengths of the lenses. The objective lenses may also be plano-convex rather than double convex. Further, the objective lenses may be coated to minimize surface reflections, and can be achromatic to correct for spherical and chromatic aberrations. Such coated and/or achromatic lenses are commercially available. A lip 22*a* at the front end of the sleeve 22 retains the adjacent spacer 58 within the sleeve. Movement of the sleeve 22 toward or away from the reducing body 20 as discussed above moves the objective lenses relative to the condensing lens to focus the light projector 12.

When the light projector 12 is assembled, all of the optical devices 46–54 are aligned and centered on the longitudinal axis L—L of the light projector.

Figure 7:
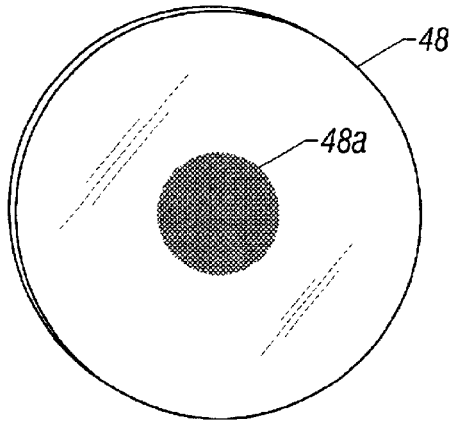
FIG. 7 is an isometric view of a light diffuser filter used in the light projector of FIGS. 1–6.

A receptacle 60 connects to electrical leads at the back of the lamp 46, and an electrical lead line 62 extends from the receptacle and outside the housing assembly of the light projector 12 to connect to a source of electrical power to operate the lamp. A grommet 63 lines the hole in the housing assembly end cap 16 through which the lead line 62 exits the housing assembly to protect the lead line from wear that might otherwise be caused by contact with the metal end cap, and possible electrical shorting. A halogen light used as the lamp 46 produces a very intense central portion of the light beam due to light projecting directly from the lamp bulb rather than being reflected from the reflector behind the lamp bulb. As shown in FIG. 7, the diffusing filter 48 is a glass disk that has a central, circular portion 48*a* that is frosted, or etched, to diffuse the light in the intense, central portion of the beam, with the result that the intensity of light is more evenly distributed across the light beam from the lamp 46. Light from the lamp 46, having passed through the filter 48, reaches the condensing lens 50 which forms an image of the light source in the lamp upon the first objective lens 52.

As noted above, a masking device is held between the holding ring 26 and the seating surface 18*a* of the main housing body 18, along the longitudinal axis of the light projector 12. The light beam from the condensing lens 50 falls on the masking device which selectively blocks some of the light beam. The objective lenses 52 and 54 produce an image of the mask at the target, or object to be illuminated by the light projector. The image of the mask is the contour, or profile, of the cross-sectional area of the light beam that falls on the mask from the condensing lens 50 and is not blocked by the mask. Thus, the mask determines the contour of the cross-sectional area of the light beam incident on the target. Three versions of masking devices, with three matching holding rings, are illustrated and discussed herein.

While it is known to use a masking device including four shutter blades, an improved masking device with four shutter blades is shown in FIGS. 8–13. A mask including four shutter blades is shown generally at 64 in FIGS. 8 and 9. The mask 64 includes blades 66, 68, 70 and 72, which are made of thin metal sheet. Blades 66, 68 and 70 have tabs 66*a*, 68*a* and 70*a*, respectively, with pads 66*b*, 68*b* and 70*b* fixed to the tabs 66*a*–70*a*, respectively, and a leading edge 66*c*, 68*c* and 70*c*, respectively, that is concave. Each of the blades 66–70 is symmetric, with its tab 66*a*–70*a*, respectively, and its concave edge 66*c*–70*c*, respectively, each centered on the body of the blade. The fourth blade 72 of the mask 64 is also symmetric, but includes two tabs 72*a* and 72*b* which extend laterally from the ends of the blade, and are bent forward as shown. The blade tabs 72*a* and 72*b* have pads 72*c* and 72*d*, respectively. The leading edge 72*e* of the blade 72 is also concave, and symmetric relative to the body of the blade and to the tabs 72*a* and 72*b*.

Figure 9:
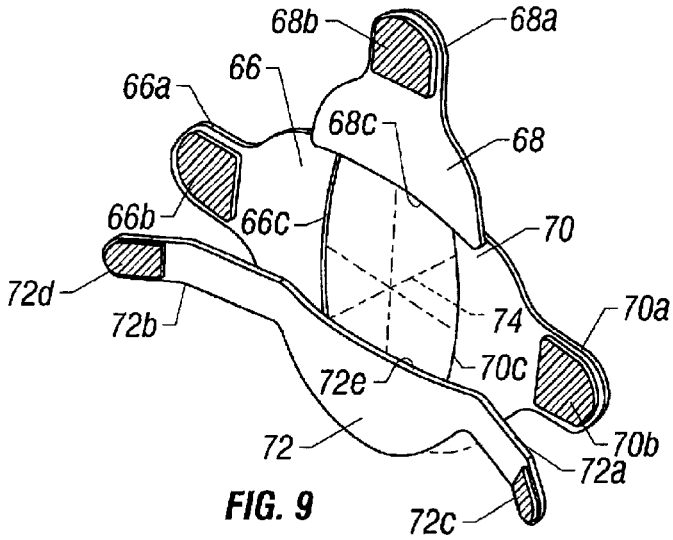
FIG. 9 is an isometric view of an array of the shutter blades of FIG. 8 as they may be arranged in a light projector according to the present invention.

In FIG. 9, the blades 66–72 are shown arranged about a representation in phantom of the cross section 74 of the light beam at the location of the seating surface 18*a* of the main housing body 18. The position and orientation of each of the blades 66–72 shape the light beam cross section 74 by selectively blocking a portion of the light beam. The position and orientation of each of the blades 66–72 may be adjusted relative to the light beam cross section 74 as needed to achieve the desired contour of the light beam cross section at the object to which the light projector 12 is aimed. The concavity of the blade edges 66*c*, 68*c*, 70*c* and 72*e* provide a self-correcting feature to compensate for the curvature of the condensing lens 50 and produce straight edges in the light beam contour at the illuminated object. Straight edges at the blades have a tendency to produce curved lines due to curvature of the lens. The concavity of the blade edges 66*c*, 68*c*, 70*c* and 72*e* may be selected to match the curvature of the condensing lens 50 to achieve the compensation. Thus, several sets of shutter blades 66–72 with different blade edge curvatures may be provided.

Figure 10:
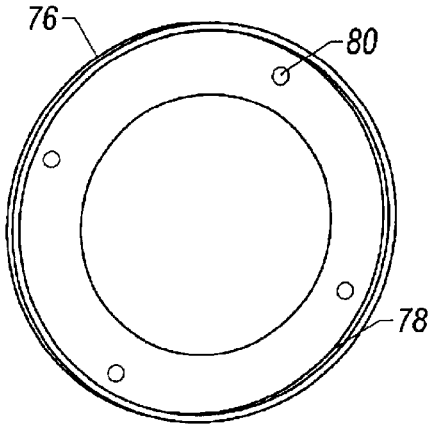
FIG. 10 is an isometric view of a holding ring for securing the shutter blades of FIGS. 8 and 9 in place in a light projector.
Figure 11:
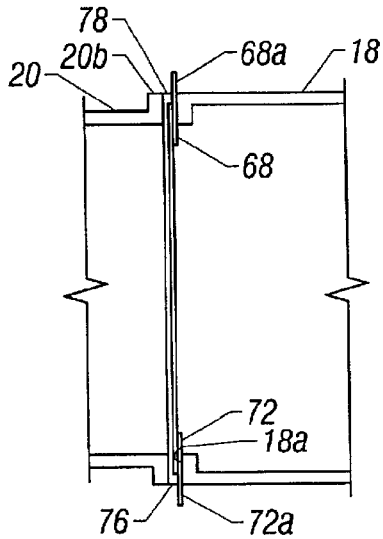
FIG. 11 is a schematic side view of a portion of a light projector, showing how the holding ring of FIG. 10 is used to secure the shutter blades of FIGS. 8 and 9 in a light projector.

A holding ring 76 specifically structured for use with the shutter blades 66–72 is shown in FIG. 10. The blade holding ring 76 has a narrow lip, or ridge, 78, around the edge of the ring, and a plurality of holes 80 for receiving the bolts 28 that attach the ring 76 between the reducing body flange 20*b* and the main housing body seating surface 18*a* (FIG. 3). The blades 66–72 are mutually overlapped and sandwiched between the holding ring ridge 78 and the seating surface 18*a*, as indicated in FIG. 11. The bolts 28 tighten in holes in the seating surface 18*a* and pinch the shutter blades between the ridge 78 of the holding ring 76 and the seating surface 18*a* to hold the blades fixed in position with compression 360° around the circumference of the ridge.

Figure 12:
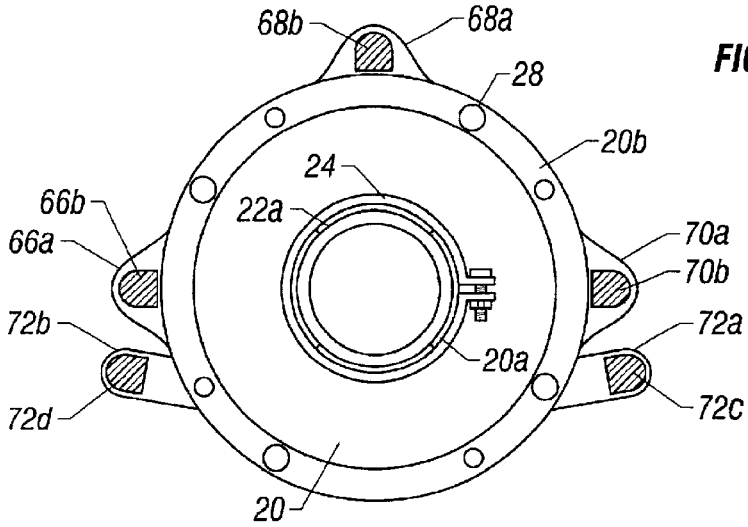
FIG. 12 is a front end elevation of a light projector according to the present invention, employing a shutter blade mask as shown in FIGS. 8 and 9.
Figure 13:
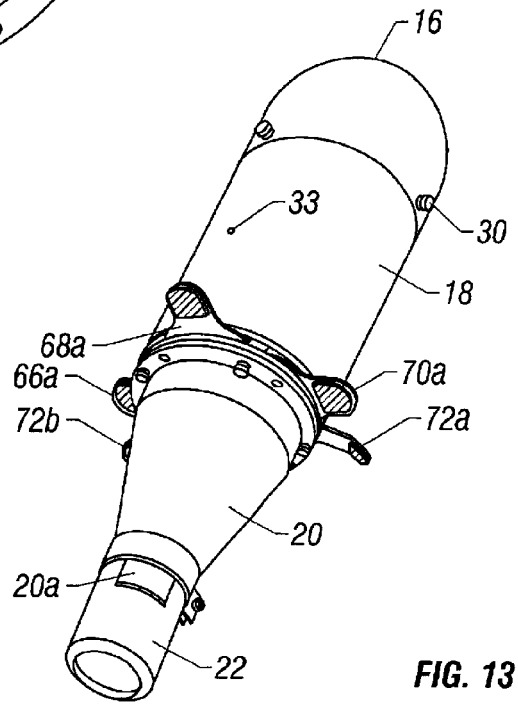
FIG. 13 is an isometric view of the light projector equipped with a shutter blade mask, as shown in FIG. 12.
Figure 8:
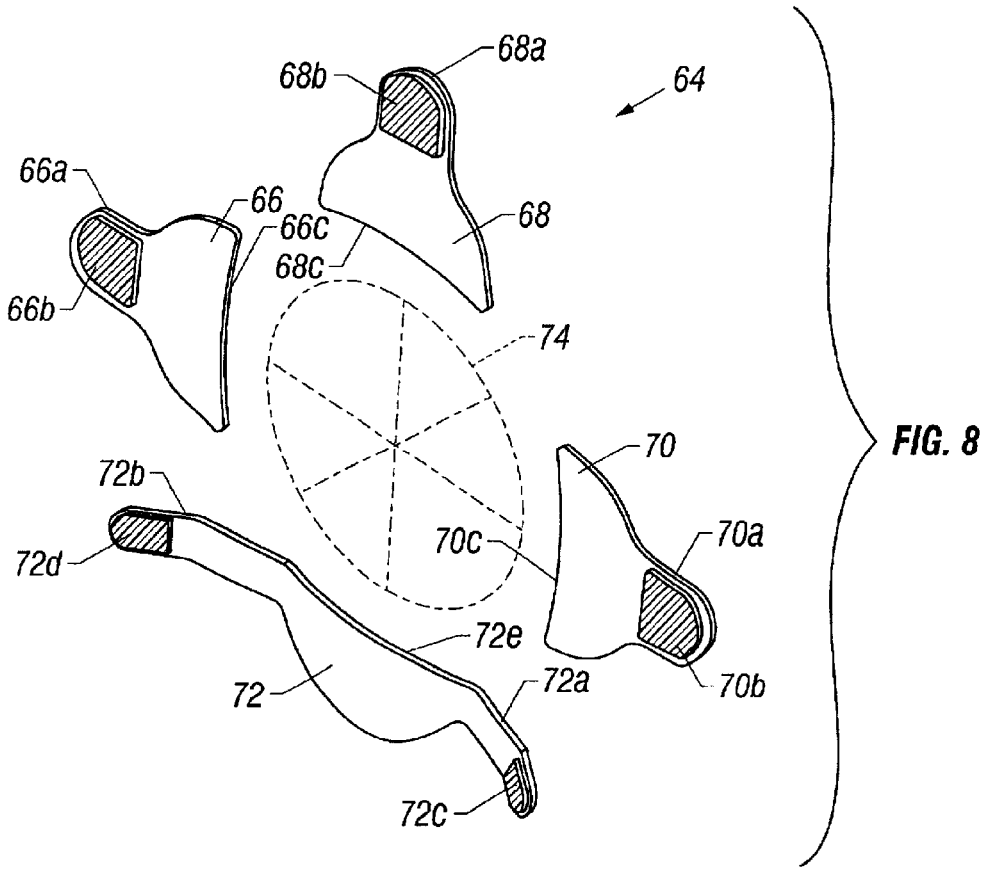
FIG. 8 is an exploded isometric view of a four-blade shutter mask for use in the light projector of FIGS. 1–6.

FIG. 12 is an end view, and FIG. 13 is a front angle view, of the light projector 12 with the shutter blades 66–72 positioned to provide a mask for the light beam emerging from the light projector. Before the bolts 28 are completely tightened, the blades 66–72 may be manipulated by hand, using their tabs 66*a*, 68*a*, 70*a*, and 72*a* and 72*b*, to achieve the desired masking pattern for the light beam. The pads 66*b*, 68*b*, 70*b*, 72*c* and 72*d* are made of high heat plastic or some other material to allow manipulation of the tabs 66*a*, 68*a*, 70*a*, 72*a* and 72*b* by hand while the tabs are hot from the heat of the lamp 46. The bolts 28 are then tightened to fix the positions of the blades 66–71.

The laterally extending tabs 72*a* and 72*b* of the bottom blade 72 allow adjustment by hand manipulation of the bottom blade when access to the light projector 12 from below the light projector is not available. Also, having the lateral tabs 72*a* and 72*b* on the bottom blade 72 rather than having a tab extending downwardly from the bottom blade allows greater latitude for placing the light projector 12 on the mounting system 14, as discussed below.

Figure 15:
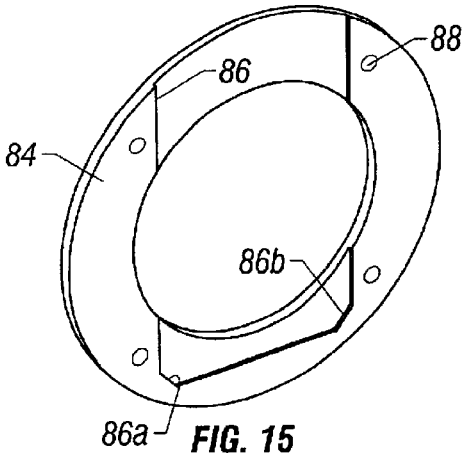
FIG. 15 is an isometric view of a holding ring for use with the custom plate mask of FIG. 14.
Figure 14:
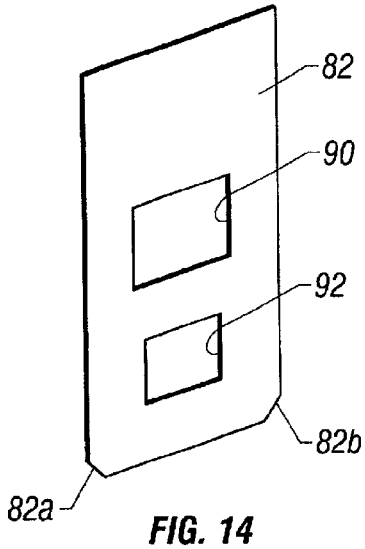
FIG. 14 is an isometric view of a custom plate mask for use in a light projector according to the present invention.

A custom plate mask 82 shown in FIG. 14 is another type of masking device for selectively shaping the contour of the light beam emerging from the light projector 12. The plate 82 is also made from thin metal sheet, such as shim stock, is generally rectangular, and features beveled corners 82*a* and 82*b*. FIG. 15 shows a holding ring designed to hold the plate 82 against the seating surface 18*a* of the main body housing. The holding ring 84 has a shallow recess, or depression, 86 formed on one side that extends across the central passage of the ring. The recess 86 is open at one end and closed at its opposite end, with beveled corners 86*a* and 86*b* at the closed end. The plate mask 82 fits within the recess 86, with the plate beveled corners 82*a* and 82*b* being received at the beveled corners 86*a* and 86*b* of the recess. With the holding ring 84 held between the reducing body flange 20*b* and the main housing body seating surface 18*a* by bolts 28 (FIG. 3), the recess 86 provides a pocket for receiving and holding the plate mask 82. The bolts 28 pass through holes 88 in the ring 84. However, the depth of the recess 86 is smaller than the thickness of the plate 82. Therefore, after the plate 82 is positioned in the recess 86, between the holding ring 84 and the seating surface 18*a*, tightening the bolts 28 causes the holding ring to compress the plate against the seating surface, holding the plate in place.

The plate mask 82 illustrated features two holes 90 and 92 which are cut specifically to give the desired shape to the light beam emerging from the light projector 12. In this case, the light beam is split in two beams. It will be appreciated that one or more holes of any shape may be cut in the plate mask 82 to achieve any desired configuration for the light from the projector 12.

Figure 17:
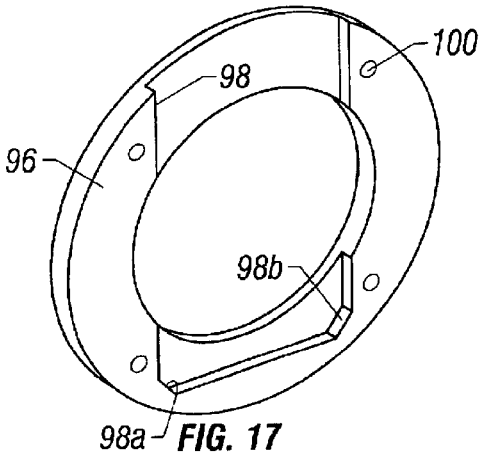
FIG. 17 is an isometric view of a holding ring for use with the glass plate photo mask of FIG. 16.
Figure 16:
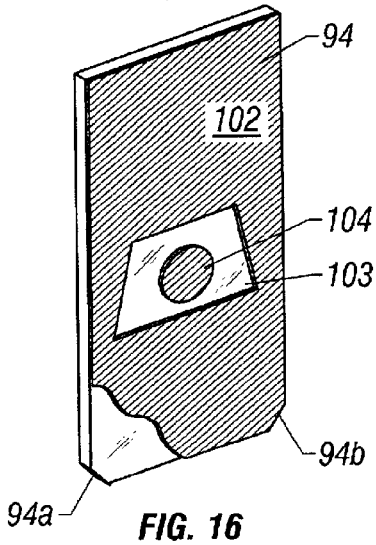
FIG. 16 is an isometric view, partially cut away, of a glass plate photo mask for use in a light projector according to the present invention.

A glass slide photo mask 94 shown in FIG. 16 is yet another type of masking device for selectively shaping the contour of the light beam emerging from the light projector 12. The slide mask 94 is constructed using a thin glass plate that is generally rectangular, and features beveled corners 94*a* and 94*b*. FIG. 17 shows a holding ring 96 designed to hold the plate 94 against the seating surface 18*a* of the main body housing 18. The holding ring 96 has a shallow recess, or depression, 98 formed on one side that extends across the central passage of the ring. The recess 98 is open at one end and closed at its opposite end, with beveled corners 98*a* and 98*b* at the closed end. The slide mask 94 fits within the recess 98, with the slide beveled corners 94*a* and 94*b* being received at the beveled corners 98*a* and 98*b* of the recess. With the holding ring 96 locked between the reducing body flange 20*b* and the main housing body seating surface 18*a* by bolts 28 (FIG. 3), the recess 98 provides a pocket for receiving and holding the slide mask 94. The bolts 28 pass through holes 100 in the ring 96. Again, the depth of the recess 98 is smaller than the thickness of the photo mask 94. Therefore, after the photo mask 94 is positioned in the recess 98, between the holding ring 96 and the seating surface 18*a*, tightening the bolts 28 causes the holding ring to compress the photo mask against the seating surface, locking the photo mask in place.

The glass slide mask 94 has a thin layer of photosensitized aluminum tape 102 held on one flat surface by an adhesive. The photosensitive tape 102 is exposed to light from the target to be illuminated, and then developed to produce a negative photograph of the target, as discussed above. However, the photo mask 94 is constructed using a glass plate. The slide mask 94 is removed from a light-tight packet, or envelope, (not shown) in the dark, and inserted into the pocket provided by the holding ring 96, with the photosensitive tape 102 facing forward, toward the holding ring 96. An aperture stop (not shown) is added to the light projector 12 as discussed above. The light projector 12 is aimed at the target to be illuminated, and light from external lamps (not shown) is directed toward the target. The photosensitive tape 102 on the slide mask 94 is exposed to light from the external lamps, reflected back from the target into the light projector. In this way, a photograph of the target is taken, with the projector 12 serving as a camera, and the photosensitized aluminum tape 102 on the glass plate 94 serving as the photographic film.

The external lamps are turned off, the slide mask 94 is removed from the projector 12 in the dark, and the photosensitive tape 102 is developed on the glass plate. A negative photographic image of the target is thus produced on the developed tape 102. A sharp, pointed blade, such as are sold under the registered trademark X-ACTO®, is used to cut the developed tape 102 to remove from the glass plate 94 that part of the tape that bears the image of the target resulting in an opening in the opaque tape that is the shape of the target image. The glass slide mask 94 is then mounted in the light projector 12 to produce a light beam that will illuminate only the target.

Any number of openings may be cut in the tape 102 to illuminate targets. Also, nested shapes, such as "doughnuts," may be cut out of the developed tape 102. In FIG. 16, the shaped hole 103 contains an opaque island 104 so that the light beam projected through the glass slide mask 94 is generally tubular. Similarly, letters may be formed with floating centers, such as in an "A," or "O," for example.

Figure 18:
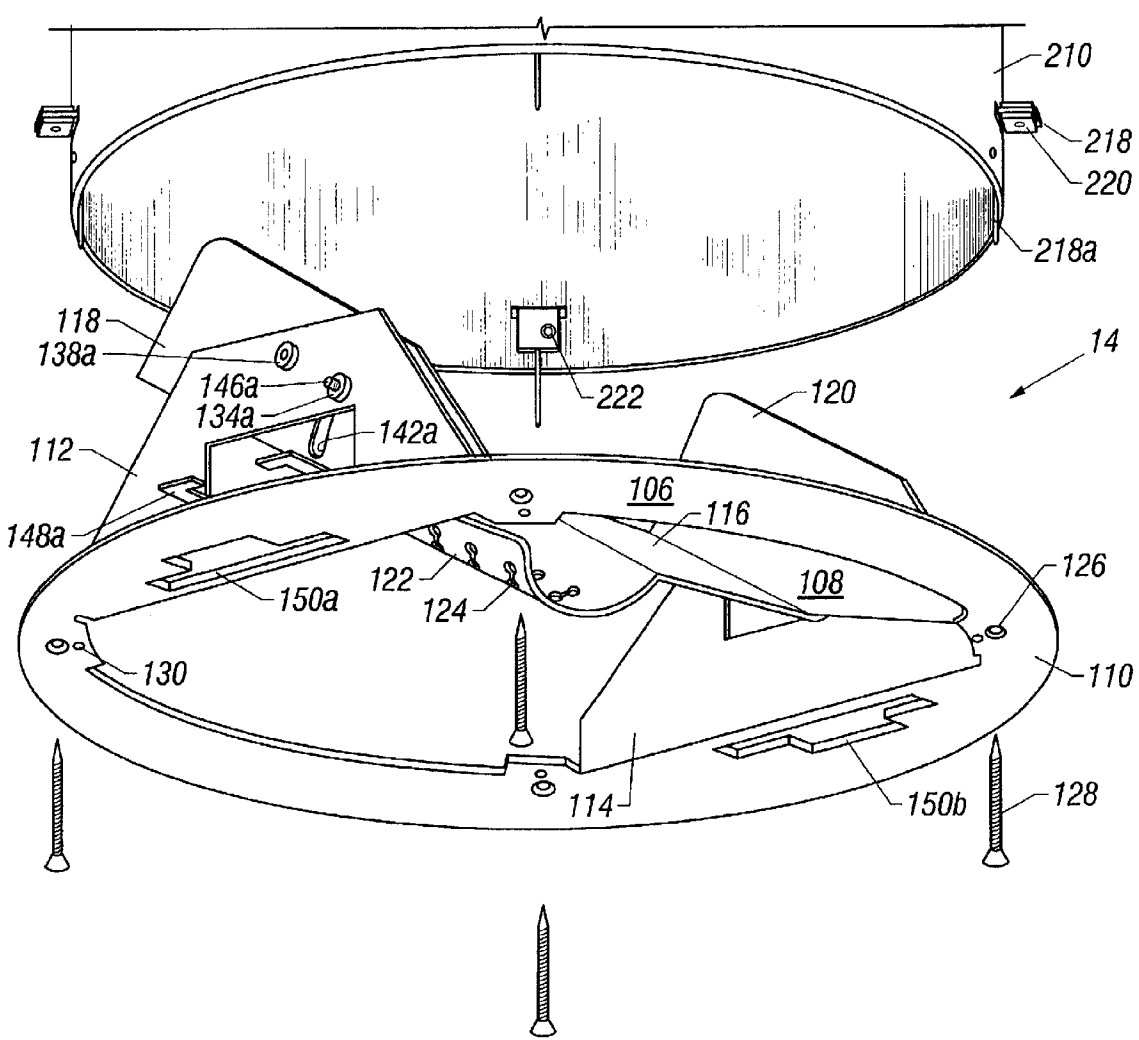
FIG. 18 is an exploded isometric view of a portion of a light system according to the present invention, showing a mounting assembly and a portion of a housing.
Figure 19:
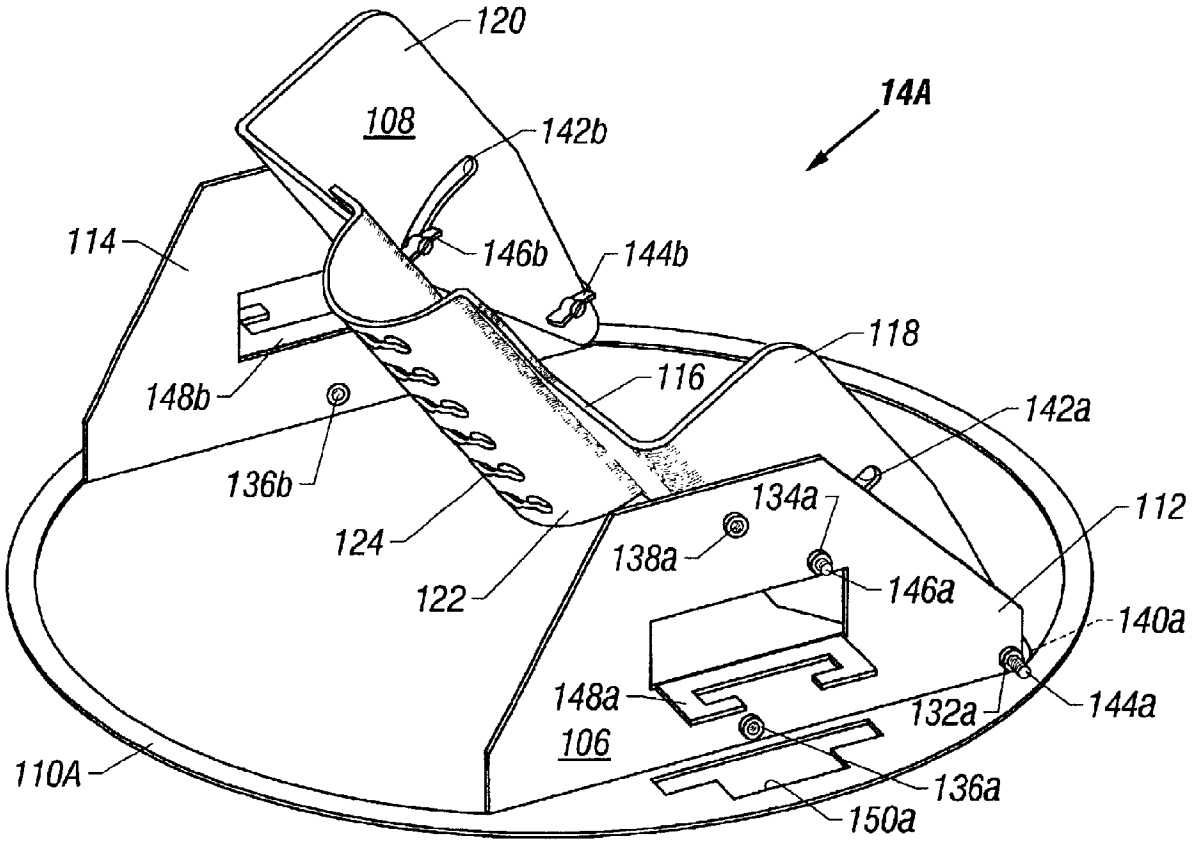
FIG. 19 is an isometric view of a mounting assembly for a light unit according to the present invention.

Details of the mounting assembly 14 of FIG. 1 may be further appreciated by reference to FIGS. 18–22. In FIG. 18 the mounting assembly is shown generally at 14, and includes a frame 106 and a saddle 108. The frame 106 includes an annular flange 110 and two retainer walls 112 and 114. The retainer walls 112 and 114 are on opposite sides of the space within the flange 110, and perpendicular to the plane of the flange. The saddle 108 includes a cross member 116 and two end walls 118 and 120 at opposite ends of the cross member, and perpendicular to the cross member. A cylindrically curved seat 122 is formed in the middle of the cross member 116. A plurality of slots 124 is provided in the seat 116. The slots 124 are structured with grooves, or notches, 124*a* facing each other along the opposite long sides of each slot. Each pair of facing grooves 124*a* forms a hole for receiving a bolt passing through the slot 124, such that the bolt is constrained against movement along the slot.

In FIGS. 19–22 a mounting assembly is shown generally at 14A. The design of the mounting assembly 14A of FIGS. 19–22 is the same as the design of the mounting assembly 14 of FIGS. 1 and 18, and identical parts of the two mounting assemblies are labeled by the same numbers, with the exception of the flange of the frame 106. The frame flange 110 of the mounting assembly 14 of FIGS. 1 and 18 has four holes 126 for receiving sheet metal screws 128 (FIG. 18) to be used for holding the mounting assembly in place in an installation, and four matching guide holes 130 for receiving guide pins, as discussed below. The mounting assembly 14A of FIGS. 19–22, with a flange 110A, is used in installations that do not require the use of screws, or bolts, or guide pins, passing through the frame flange 110A. Therefore, the frame flange 110A of the mounting assembly 14A does not have the holes 126 and 130 of the frame flange 110 of the mounting assembly 14, and is also narrower than the frame flange 110.

Referring now to FIGS. 1 and 18–22, it can be seen that the mounting assemblies 14 and 14A each provide the same dual pivot system. Four threaded bushings 132*a*, 134*a*, 136*a*, and 138*a* are provided in holes in the frame retainer wall 112, and four threaded bushings 132*b*, 134*b*, 136*b*, and 138*b* (designated in phantom in FIGS. 20 and 22) are provided in holes in the frame retainer wall 114, with each bushing in one retainer wall in the same position in the wall as is one bushing in the opposite retainer wall. The bushings 132*a* and 136*a* provide two pivot receptacles in the retainer wall 112, and the bushings 132*b* and 136*b* provide two pivot receptacles in the retainer wall 114. The bushings 134*a* and 138*a* provide two guide receptacles in the retainer wall 112, and the bushings 134*b* and 138*b* provide two guide receptacles in the retainer wall 114. Pivot holes, not visible and therefore designated in phantom at 140*a* and 140*b* in FIGS. 19–22, are provided at the end of each saddle end wall 118 and 120, respectively, again with these two pivot holes in the same position in the respective end wall. An arcuate guide slot 142*a* is provided in one saddle end wall 118, and a like arcuate guide slot 142*b* is provided in the other saddle end wall 120, with the two arcuate guide slots positioned in the same relative place on their respective end walls.

Four bolts 144*a*, 144*b*, 146*a*, and 146*b* are used in conjunction with the threaded receptacles 132*a*–138*b* to configure the mounting assembly 14/14A in one pivot arrangement or the other. Bolts 144*a* and 144*b* serve as pivot members, and bolts 146*a* and 146*b* serve as guide members.

In FIGS. 1, 18, 19, and 21 bolt 144*a* passes through the pivot hole 140*a* at the end of the saddle wall 118 and is threaded through the first pivot receptacle 132*a* in the retainer wall 112, and bolt 144*b* passes through the pivot hole 140*b* at the end of the saddle wall 120 and is threaded through the first pivot receptacle 132*b* in the retainer wall 114. The pivot member bolts 144*a* and 144*b* thus provide an axle, and define a first pivot axis, passing through the first pivot receptacles 132*a* and 132*b*, about which the saddle 108 may pivot, or rotate, relative to the frame 106. Such rotation is limited by the guide member bolts 146*a* and 146*b* passing through the arcuate guide slots 142*a* and 142*b* in the end walls 118 and 120, respectively, and being threaded into the first guide receptacles 134*a* and 134*b* in the retainer walls 112 and 114, respectively. If the pivot members 144*a* and 144*b*, and the guide members 146*a* and 146*b*, are not tightened in the respective threaded holes 132*a*–134*b*, the saddle 108 is free to be moved in an arc about the first axis defined by the pivot members in the holes 132*a* and 132*b*, and limited by the arcuate holes 142*a* and 142*b* in the saddle moving relative to the guide members 146*a* and 144*b* in the guide receptacles 134*a* and 134*b*, respectively. Tightening the bolts 144*a*–146*b* causes the saddle 108 to be locked, by friction, in a selected position relative to the frame 106, as shown in FIGS. 1, 18, 19, and 21, for example.

Figure 20:
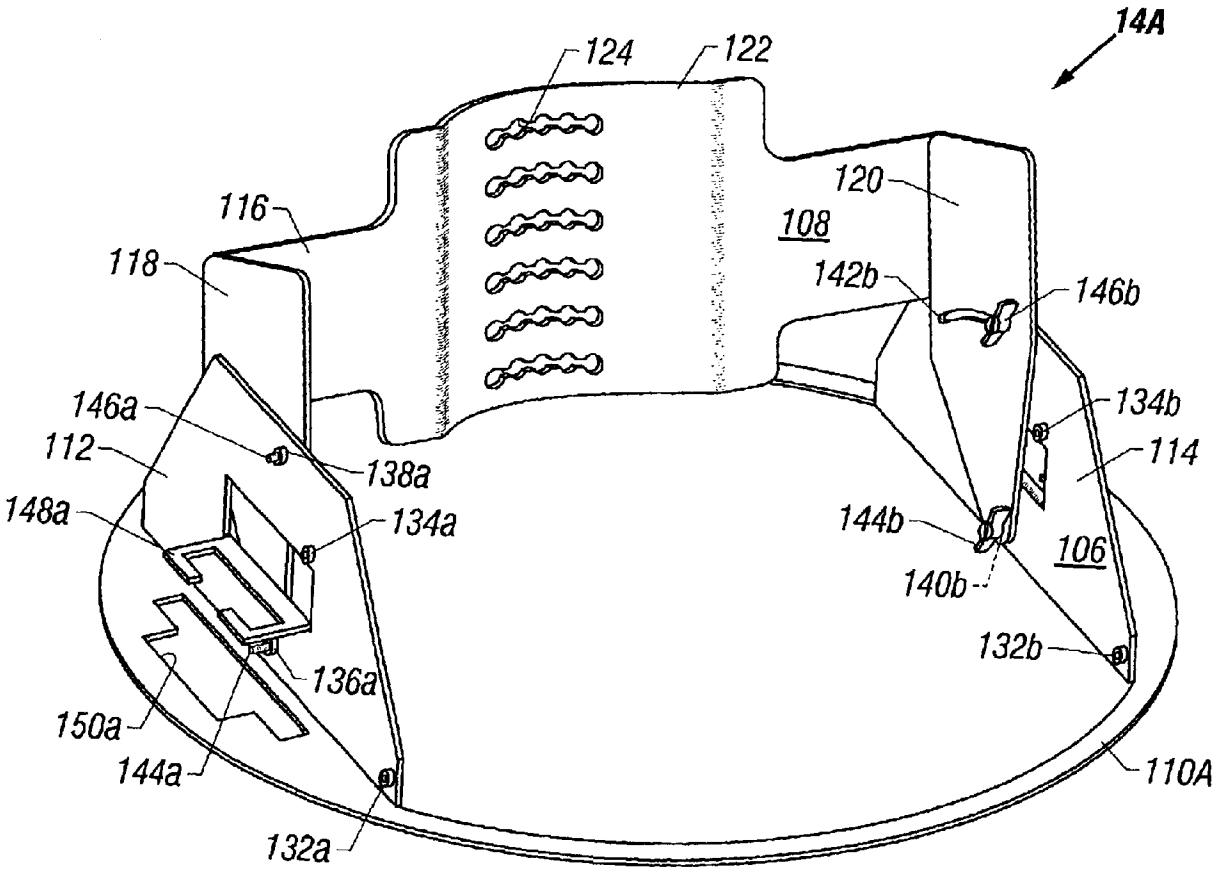
FIG. 20 is another isometric view of the mounting assembly of FIG. 19, in another configuration.
Figure 22:
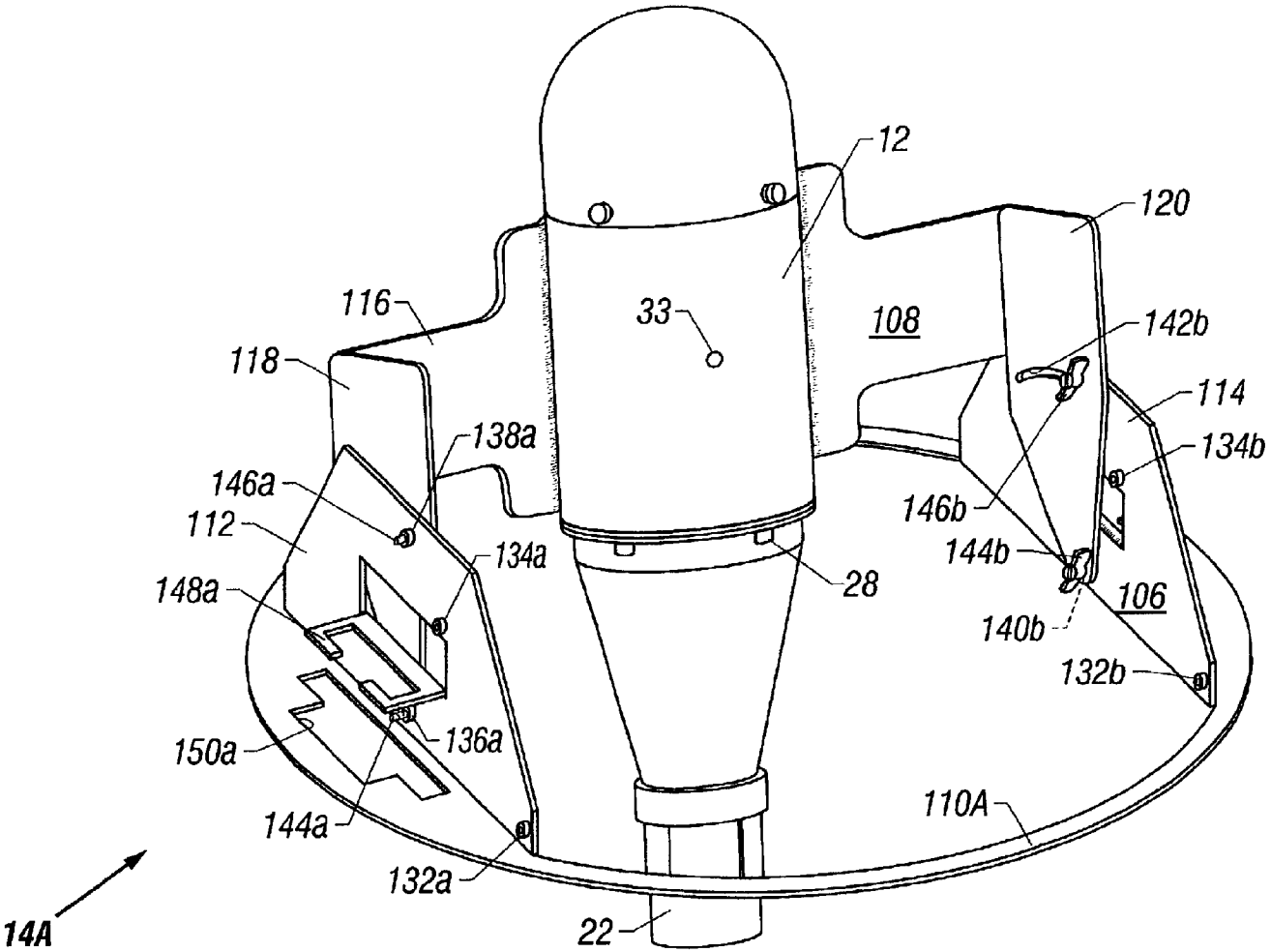
FIG. 22 is an isometric view similar to the view of FIG. 20, but showing a light projector joined to the mounting assembly.

In FIGS. 20 and 22 pivot member bolt 144*a* passes through the pivot hole 140*a* at the end of the saddle wall 118 and is threaded through the second pivot receptacle 136*a* in the retainer wall 112, and pivot member bolt 144*b* passes through the pivot hole 140*b* at the end of the saddle wall 120 and is threaded through the second pivot receptacle 136*b* in the retainer wall 114. The pivot member bolts 144*a* and 144*b* thus provide an axle, and define a second pivot axis, passing through the second pivot receptacles 136*a* and 136*b*, about which the saddle 108 may pivot, or rotate, relative to the frame 106. Such rotation is limited by the guide member bolts 146*a* and 146*b* passing through the arcuate guide slots 142*a* and 142*b* in the end walls 118 and 120, respectively, and being threaded into the second guide receptacles 138*a* and 138*b* in the retainer walls 112 and 114, respectively. If the pivot members 144*a* and 144*b*, and the guide members 146*a* and 146*b*, are not tightened in the respective threaded holes 136*a*–138*b*, the saddle 108 is free to be moved in an arc about the second axis defined by the pivot members in the holes 136*a* and 136*b*, and limited by the arcuate holes 142*a* and 142*b* in the saddle moving relative to the guide members 146*a* and 144*b* in the guide receptacles 138*a* and 138*b*, respectively. Tightening the bolts 144*a*–146*b* causes the saddle 108 to be locked, by friction, in a selected position relative to the frame 106, as shown in FIGS. 20 and 22, for example.

It will be appreciated that a wide range of orientations of the saddle 108 may be achieved relative to the frame 106 with the use of the dual pivot system, with its two axes of pivot, or rotation, from which to choose, and the arcs through which the saddle may be positioned relative to the axes.

Figure 21:
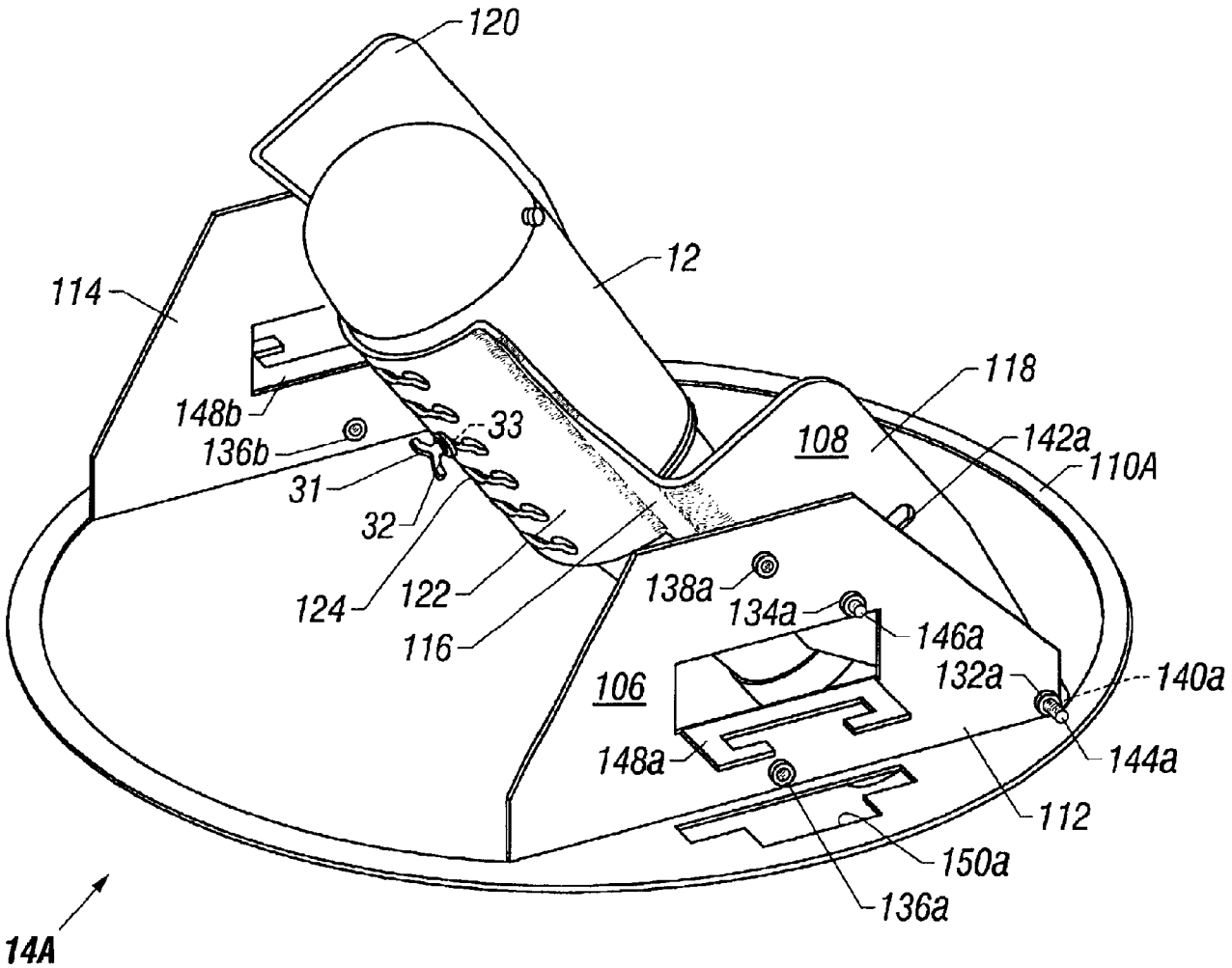
FIG. 21 is an isometric view similar to the view of FIG. 19, but showing a light projector joined to the mounting assembly.

The light projector 12 is attached to the saddle 108 by a wing bolt 32 passing through one of the grooved slots 124 in the seat 122 of the saddle cross member 116 and threaded into a hole 33 in the light projector main housing body 18, as indicated in phantom in FIG. 21. The use of grooves 124*a* insures that the light projector 12, once removed from the saddle 108, may be reinstalled in the same orientation in the saddle by passing the bolt 32 through the same groove in the same slot 124. The plurality of the slots 124 allows the light projector 12 to be so attached at different selected positions along the seat 122, and thus at different positions relative to the frame 106. If an old style shutter blade masking device is used with the light projector 12, the tab protruding from the bottom shutter blade would limit the positioning of the light projector along the seat 122, requiring the light projector to be positioned low, or forward, enough for the tab to be in front of the seat. The improved shutter blade mask shown in FIGS. 8, 9, 12 and 13 has the dual tabs 72*a* and 72*b* of the bottom shutter blade 72 extending laterally, and thus avoiding interference with the saddle seat 122 regardless of the position of the light projector 12 along the seat.

The dual pivot system of the mounting assemblies 14 and 14A provides new and extensive capabilities for orienting a light projector 12, including positioning the light projector to aim vertically. Further, the light projector 12 may also be selectively positioned at a variety of locations along the saddle seat 122.

The frame retainer walls 112 and 114 have openings cut, and material folded outwardly, to form end brackets 148*a* and 148*b*, respectively. The flanges 110 and 110A are cut to form a structured, generally elongate hole 150*a* and 150*b* below each end bracket 148*a* and 148*b* as shown. The end brackets 148*a* and 148*b* and the flange holes 150*a* and 150*b* are used in installations of the mounting assemblies 14 and 14A, as discussed below.

In general, a light projector according to the present invention may be installed above a ceiling for projection of light through the ceiling toward a selected target. The light projector may be positioned within a housing, which is placed above the ceiling. Several different types of installations are described and illustrated.

Figure 23:
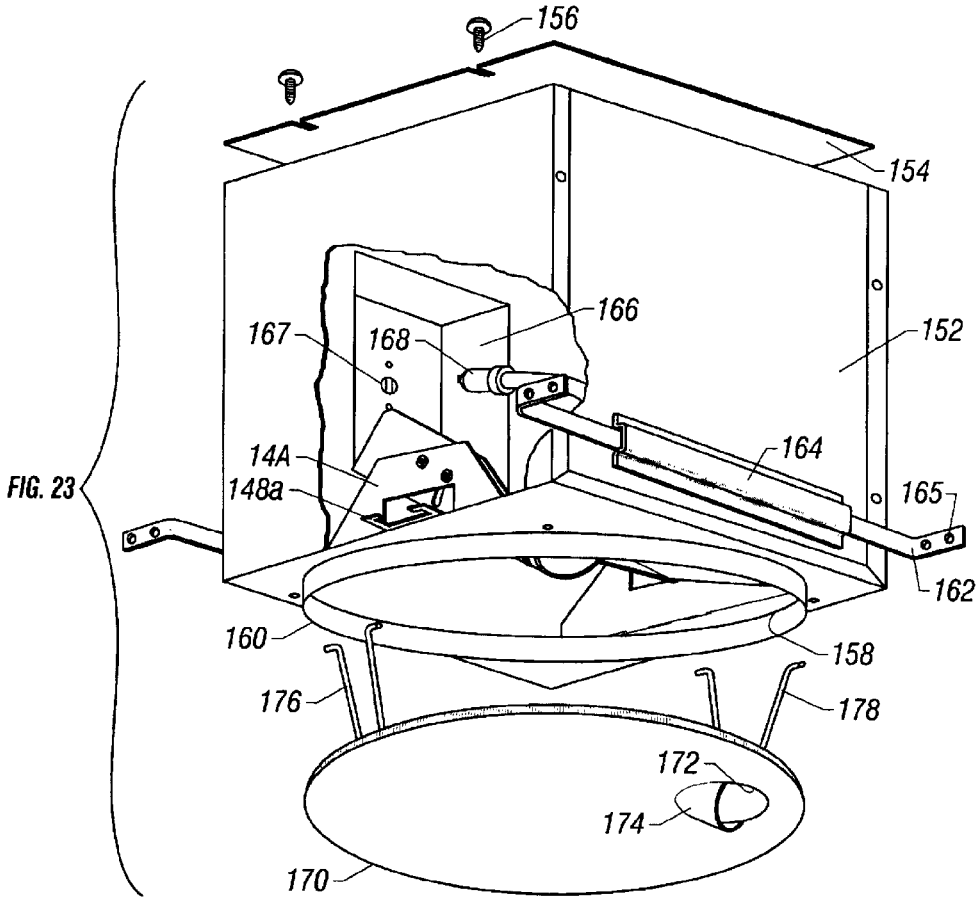
FIG. 23 is an exploded isometric view of a portion of a lighting system for installation in new construction according to the present invention.

FIGS. 23 and 24 show an arrangement that may be used during the construction of a room, for example, wherein a housing may be installed before the ceiling is completed, but where no access from above the ceiling is available after completion of the construction. The housing includes a square, aluminum box, or enclosure, 152 having a removable top 154 that is held on by screws 156. A round hole 158 breaks the bottom of the box 152 and is surrounded by a downwardly extending lip 160. Multiple brackets 162 are adjustable by sliding in sleeves 164 attached to the sides of the enclosure 152. The box 152 is positioned above a ceiling among beams or the like, and the brackets 162 are adjusted so that they may be fixed to beams by nails or screws passing through holes 165 in the ends of the brackets to anchor the box. A recess 166 is provided in the enclosure 152, with an electrical receptacle 167 positioned in the back of the recess. An electrical connection box (not visible) is joined to the outside of the recess 166, and provides terminals by which electrical power may be received at the receptacle 167. The enclosure 152 is thus positioned and mounted among ceiling rafters or the like so as to accommodate the recess 166 and the external electrical connection box. A mounting assembly 14A is positioned within the enclosure 152 to hold the light projector 12 as discussed above. The recess 166 provides room to receive the back end of the light projector 12 in various orientations of the projector. The electrical lead line 62 from the projector lamp 46 (FIG. 3) is covered in heat insulation and connected to a plug 168, as indicated in FIG. 23, which is received by the receptacle 167.

Figure 25:
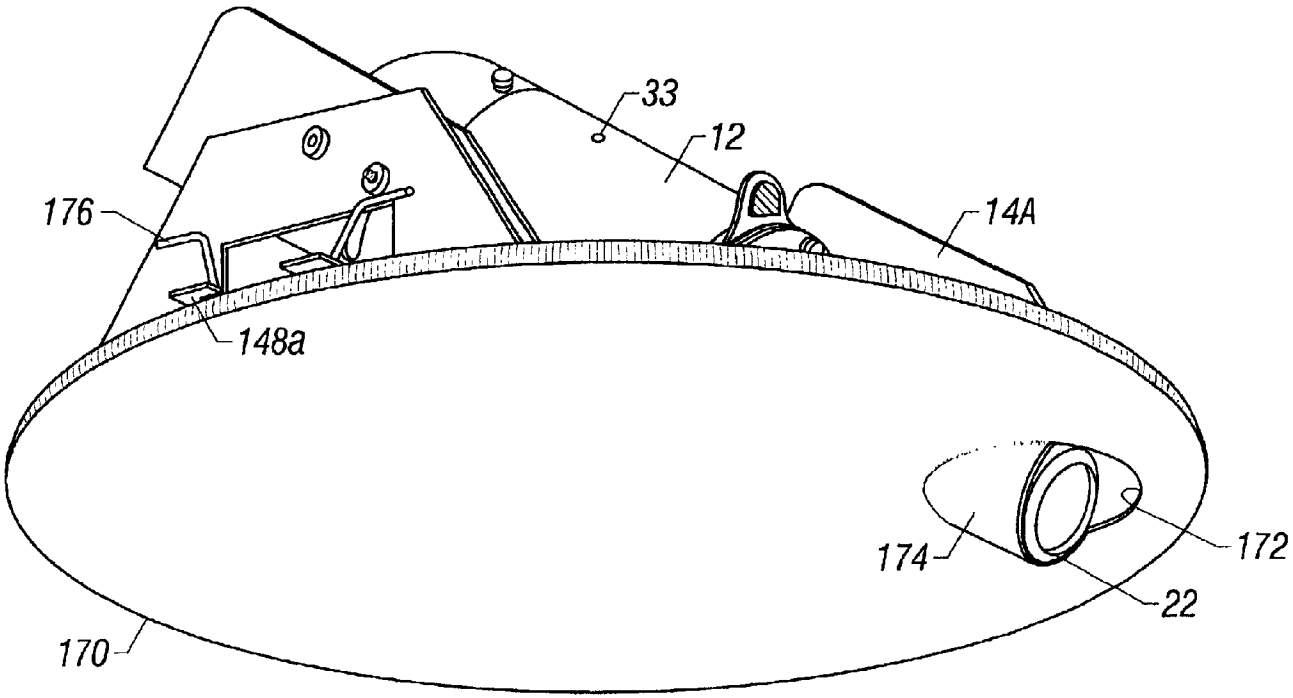
FIG. 25 is an isometric view of a light unit as shown in FIGS. 23 and 24, showing a cover plate attached to the mounting assembly.

After the enclosure 152 is anchored above the ceiling with the light projector 12 and mounting assembly 14A in place, the bottom hole 158 may be closed using a circular cover plate 170. The diameter of the cover plate 170 is such that the upwardly curved edge of the cover plate just closes over the bottom edge of the lip 160. The cover plate 170 is broken by an elliptical light projection hole 172. As shown in FIG. 25, the hole 172 receives the light projector focal lens sleeve 22 that extends down beyond the bottom edge of the lip 160. A hood 174 across the hole 172 shrouds the sleeve 22 to provide a finished look to the installation. The hood 174 is shaped as a portion of a cylinder. FIG. 26 illustrates an alternative hood 174*a*, which is shaped as a portion of a sphere. Either hood 174 or 174*a* may be used with the plate 170 to shroud the sleeve 22.

The cover plate 170 is held in place against the bottom edge of the lip 160 by two spring hangers 176 and 178. The hanger 176 is made from a single wire that is wrapped multiple times around a hub 180 attached to the top surface of the cover plate 170, with the wire extending from the hub to form two arms, as shown in FIG. 24. Similarly, the hanger 178 is made from a single wire that is wrapped multiple times around a hub 182 attached to the top surface of the cover plate 170, with the wire extending from the hub to form two arms, as shown in FIG. 24. The wrapping of the wires of the arms 176 and 178 about the hubs 180 and 182, respectively, renders the arm structures elastic about the hubs. The arms of the hangers 176 and 178 are sufficiently resilient that they may be squeezed together to fit through the holes 150*a* and 150*b* of the flange 110A (FIGS. 19–22) and be received within the retainer wall end brackets 148*a* and 148*b*, respectively. The hub mountings 180 and 182 fit through the wider portions of the holes 150*a* and 150*b*. When the arms of the hangers 176 and 178 are released within the brackets 148*a* and 148*b*, the arms are captured and held by the brackets. The cover plate 170 may be pushed up against the bottom of the lip 160, forcing the hangers 176 and 178 further through the brackets 148*a* and 148*b*, respectively, allowing the hanger arms to spread apart. The frictional forces between the brackets 148*a* and 148*b* and the hangers 176 and 178 hold the cover plate 170 in place, generally even with the surrounding surface of the ceiling (not shown).

In addition to adjusting the position of the light projector 12 along the saddle seat 122, and tilting the saddle 118 about one or the other of the two pivot axes provided by the mounting assembly 14A, the mounting assembly itself may be rotated about the interior of the housing 152 to select the vertical plane along which the light projector will be oriented. Nuts and washers 184 are tightened down on the flange 110A on bolts 186 passing through the bottom of the enclosure 152 to hold the flange fixed relative to the enclosure when the flange is in the desired orientation.

During construction, access is available from above the ceiling to install the enclosure 152 and its contents from above the ceiling. The enclosure 152 may be placed on a beam or ceiling member 188, and otherwise anchored in place using the adjustable brackets 162 as discussed above. The lip 160 extends down through the ceiling member 188 so that the plate 170 is at the level of the ceiling bottom surface when the plate is held against the lip. The orientation of the light projector 12 may be adjusted through the bottom hole 158. Further, the light projector mask may be adjusted from below, through the same hole 158. A shutter blade mask is included in the light projector 12 shown in FIG. 23, and the shutter blades may be adjusted as needed, for example. After adjustments to the light projector are completed, the cover plate 70 may be put in place. At any time after installation, and completion of the ceiling construction, the cover 170 may be pulled down and the light projector accessed though the bottom hole 158. The plate 170 may be suspended below the level of the ceiling on the hangers 176 and 178 while the hangers are still held by the end brackets 148*a* and 148*b*, or with the hangers instead held by friction by the edges of the structured holes 150*a* and 150*b* in the flange 110A (FIGS. 19–22). The ends of the arms of the hangers 176 and 178 are bent so that they may be caught either against the end brackets 148*a* and 148*b*, or against the edges of the structured flange holes 150*a* and 150*b*, as alternatives for suspending the plate 170 during maintenance or adjustment operations.

Figure 27:
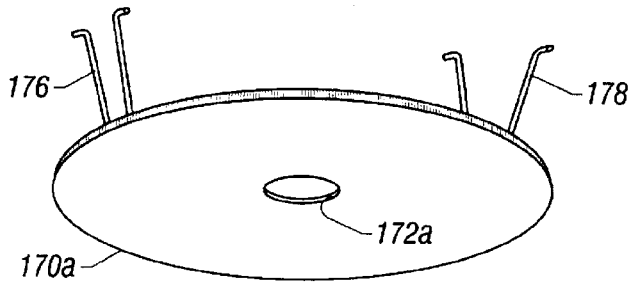
FIG. 27 is an isometric view of another version of a cover plate.

FIG. 27 shows an alternate cover plate 170*a*, featuring a central, circular light projection hole 172*a* for receiving the focal lens sleeve 22 when the light projector is oriented to project light vertically, or nearly vertically, downwardly. Otherwise, the cover plate 170*a* may be like the cover plate 170, including having the two spring hangers 176 and 178 for suspending the cover plate 170*a* against the enclosure lip 160, for example.

Figure 28:
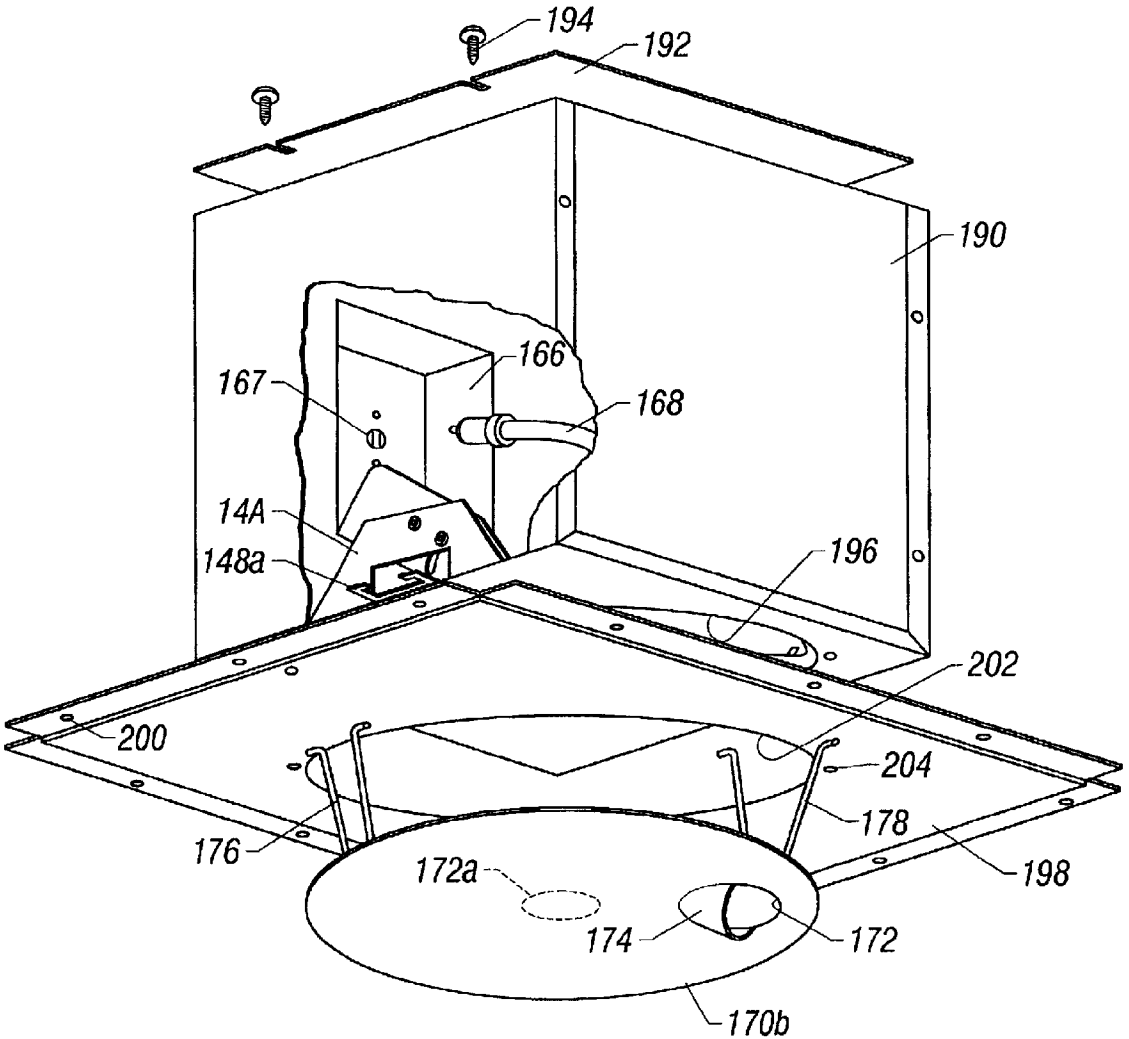
FIG. 28 is an exploded isometric view of a portion of a lighting system for installation in new construction, or in remodeling existing construction, according to the present invention, wherein the bottom of the system may be floated with the ceiling.
Figure 29:
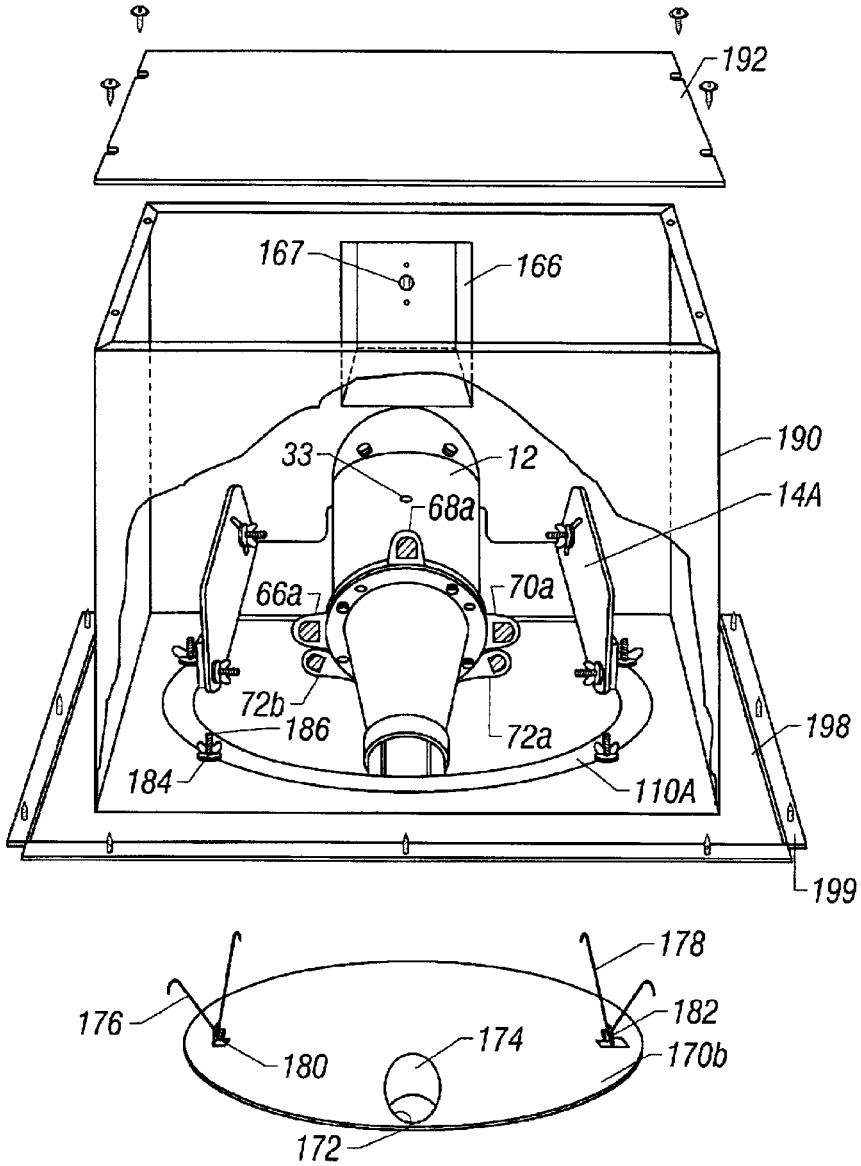
FIG. 29 is an exploded isometric view of the lighting system of FIG. 28, showing a light projector joined to the mounting assembly.

FIGS. 28 and 29 show an installation which can be mounted with or without access from above a ceiling, and be used in new construction or in remodeling existing construction. The completed installation is floated with the ceiling to produce a continuous finish. The housing of the arrangement includes a square, aluminum box, or enclosure, 190 having a removable top 192 that is held on by screws 194. A round hole 196 breaks the bottom of the enclosure 190. A rectangular, aluminum panel 198 is used to support the enclosure 190. The panel 198 is sized, with one side longer than the other side, to fit against beams or the like in the ceiling structure, and held there by flat head nails or screws 199 passing through tapered holes 200 along the periphery of the panel and into the beams. The panel 198 has a round hole 202 that is larger in diameter than the bottom hole 196 of the enclosure 190. The enclosure 190 is fixed to the panel 198 with nuts 184 tightened down on bolts 186 (FIG. 27) passing through holes 204 in the panel, arranged about the panel hole 202, and corresponding holes in the bottom of the enclosure, arranged about the hole 196. Thereafter, the enclosure 190 is positioned between ceiling beams and the panel 198 anchored to the beams as noted above. A recess 166 is provided in the enclosure 190, with an electrical receptacle 167 positioned in the back of the recess. An electrical connection box (not visible) is joined to the outside of the recess, and provides terminals by which electrical power may be received at the receptacle 167. The enclosure 190 is thus positioned and mounted among ceiling rafters or the like so as to accommodate the recess 166 and the external connection box. A mounting assembly 14A is positioned within the enclosure 152 to hold the light projector 12 as discussed above. The recess 166 provides room to receive the back end of the projector 12 in various orientations of the projector. The electrical lead line 62 from the projector lamp 46 (FIG. 3) is covered in heat insulation and connected to a plug 168, as indicated in FIG. 28, which is received by the receptacle 167.

The enclosure bottom hole 196 and the panel hole 202 may be closed using a circular cover plate 170*b*, which receives the focal lens sleeve 22 of a projector 12 in the elliptical light projection hole 172, as discussed above in connection with the arrangement of FIGS. 23 and 24. The edge of the cover plate 170*b* is flat, but in all other aspects the cover plate 170*b* may be like the cover plate 170. Either the semi-cylindrical hood 174 of FIG. 25 or the semi-spherical hood 174*a* may be used with the cover plate 170*b*. The diameter of the cover plate 170*b* is such that it just fits within the panel hole 202 and is held against the bottom of the enclosure 190 by the two spring hangers 176 and 178, which function as discussed above. Alternatively, a version of the cover plate 170*a* of FIG. 27 may be used for vertical, or nearly vertical, orientations of the light projector 12, providing the edge of the plate is flat (not shown).

The mounting assembly 14A is positioned in the bottom of the housing 190, and rotated to a desired orientation. Thereafter, the mounting assembly 14A is held in place by the nuts and washers 184 tightened down against the frame flange 110A on the bolts 186 holding the panel 198 to the enclosure 190.

After the enclosure 190 is attached to ceiling structural members using the panel 198 as noted above, the panel is floated and textured to match the ceiling for a continuous finish. The periphery of the panel 198 where the screws or nails are used in the countersunk holes 200 is offset so that the floating material deposited along the periphery provides a finish surface that is at the same level as the finished surrounding ceiling material. The orientation of the light projector 12 may thereafter be adjusted through the holes 196 and 202. Further, the light projector mask may be adjusted from below, through the same holes 196 and 202. Again, a shutter blade mask is included in the light projector 12 shown in FIG. 29, for example. After adjustments to the light projector are completed, the cover plate 170*b* may be put in place, flush with the plate 198 and the surrounding ceiling to present a continuous surface finish. The orientation of the cover plate 170*b* will match the orientation of the projector 12 as the hangers 176 and 178 are passed through the mounting assembly flange holes 150*a* and 150*b* and received by the end brackets 148*a* and 148*b*, respectively. At any time after installation, the cover 170*b* may be pulled down and the light projector accessed though the holes 196 and 202.

Figure 30:
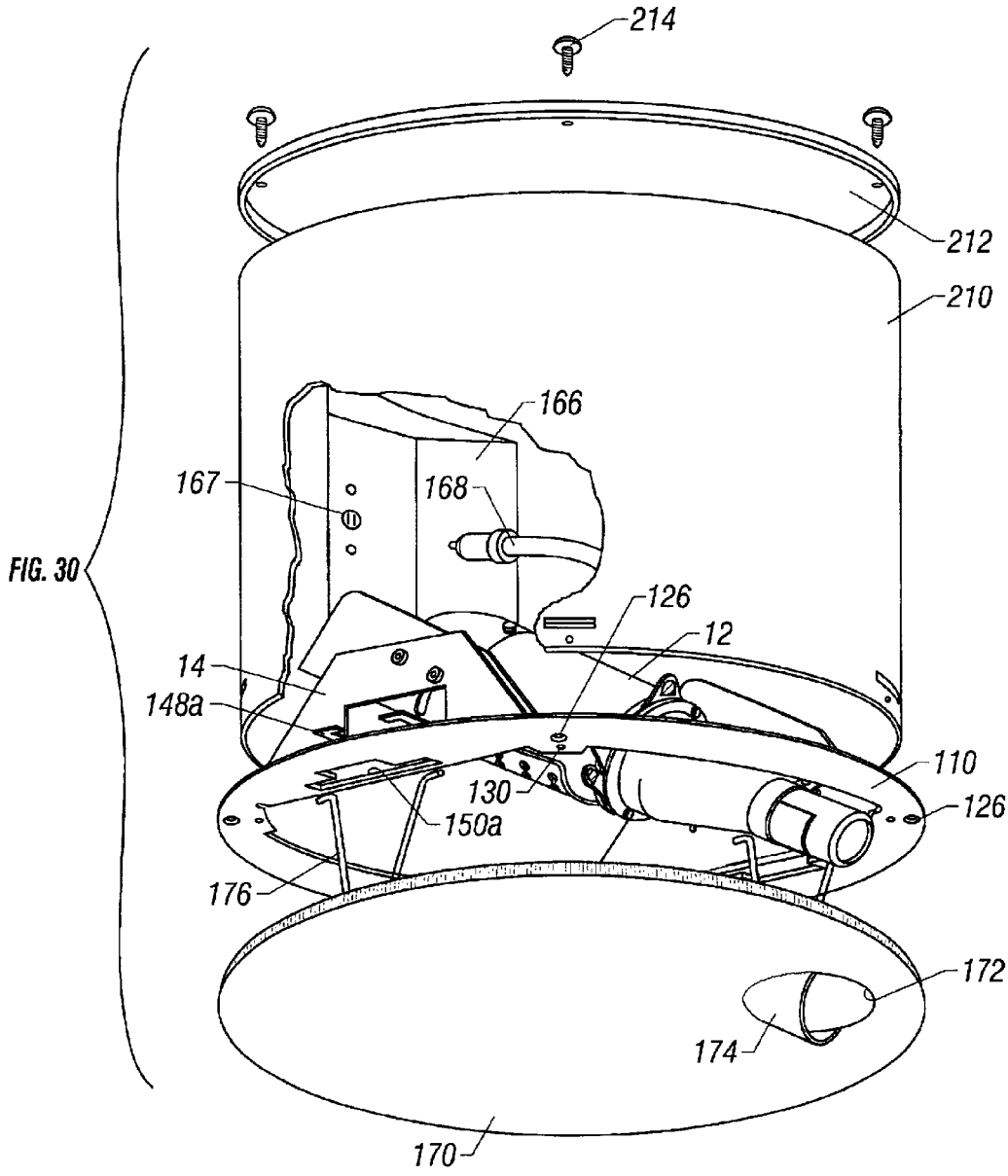
FIG. 30 is an exploded isometric view of a lighting system, shown partly in FIG. 18, for installation through a completed ceiling according to the present invention.

FIGS. 18, 30 and 31 show an installation that is useful in remodeling operations, for example, wherein no access from above the ceiling is available to carry out the installation itself. A housing for the installation includes a round, aluminum enclosure 210 having a removable top 212 that is held on by screws 214. The bottom of the enclosure 210 is open. A recess 166 is provided in the enclosure 210, with an electrical receptacle 167 positioned in the back of the recess. An electrical connection box (not visible) is joined to the outside of the recess, and provides terminals by which electrical power may be received at the receptacle 167. The recess 166 provides room to receive the back end of a light projector 12 in various orientations of the projector. The electrical lead line 62 from the projector lamp 46 (FIG. 3) is covered in heat insulation and connected to a plug 168, as illustrated n FIG. 30, which is received by the receptacle 167.

The enclosure 210 is inserted upwardly into a hole cut in an existing ceiling 216. Four retaining clips 218 are used to anchor the installation to the ceiling 216. The construction and use of the retaining clips 218 may be appreciated by reference to FIGS. 18, 32 and 33. Each retaining clip 218 has two flat segments, or plates, at 90° relative to each other, and each plate has a hole. A guide pin 218*a* extends from one of the flat plates. A nut 220, sold under the registered trademark TINNERMAN®, is slipped over the flat plate, not including the guide pin 218*a*, of each retaining clip 218 and the holes in the nut are aligned with the plate hole. As shown in FIG. 32, a TINNERMAN® nut comprises a folded metal strip with mutually aligned holes that can receive a screw that threads into the holes. After the enclosure 210 has been inserted into the hole in the ceiling drywall 216, each of the retaining clips 218 is installed with its flat plate with the TINNERMAN® nut inserted horizontally through a slot in the side of the enclosure, as shown in FIG. 18. A plastic snap-in pin 222 is passed through the hole in the other, vertical flat plate of the retaining clip 218, and then through a hole in the side of the enclosure 210. The snap-in pin 222 is held in the side hole of the enclosure 210 by friction, to thereby hold the retaining clip 218 fixed to the enclosure. The horizontal flat plates of the four retaining clips 218 extend radially outwardly from the enclosure 210 above the level of the top of the ceiling drywall 216 and rest on the top of the drywall so that the ceiling thus supports the enclosure. At the same time, the guide pins 218*a* extend vertically downwardly below the bottom edge of the enclosure 210, as shown in FIG. 18.

A mounting assembly 14 is placed in position against the bottom of the enclosure 210. The outer diameter of the frame flange 110 is greater than the diameter of the enclosure 210, as well as the diameter of the hole in the ceiling material 216. As the mounting assembly 14 is raised, the guide pins

218*a* are received in the guide holes 130 in the flange 110 (FIG. 18), and orient the mounting assembly so that the screw holes 126 in the flange 110 are aligned with the holes in the horizontal plates of the retaining clips 218. The sheet metal screws 128 are then passed through the flange screw holes 126 and threaded into the holes in the TINNERMAN® nuts 220 enclosing the horizontal plates of the retaining clips 218 to anchor the mounting assembly 14 and the enclosure 210 to the ceiling 216. Then, the portions of the guide pins 218*a* that extend down below the bottom of the frame flange 110 may be broken off.

A light projector 12 may be joined to the mounting assembly 14 either before or after the mounting assembly is installed in the housing 210. With the light projector 12 installed and electrically connected to the power source by way of the receptacle 167 in the recess 166, a cover plate 170 is installed, using the hangers 176 and 178 to engage the end brackets 148*a* and 148*b* on the mounting assembly 14 as discussed above, to cover the bottom of the mounting assembly 14 and provide a finished look to the installation. The upwardly curved edge of the plate 170 fits around the outer edge of the flange 110. Again, the focal lens sleeve 22 of the light projector 12 passes through the elliptical light projection hole 172 in the cover plate 170, and is partially shrouded by the hood 174 to complete the finished look of the installation. Alternatively, the semi-spherical hood 174*a* of FIG. 26 may be used rather than the semi-cylindrical hood shown in FIG. 30. Also, for a vertical, or near vertical, orientation of the light projector 12, the cover plate 170*a* of FIG. 27 may be used with the focal lens sleeve 22 extending through the central, circular opening 172*a*.

The orientation of the light projector 12, and the setting of its mask device, such as the shutter blades indicated by the presence of the shutter blade tabs 66*a*–72*b* in FIG. 31, may be made by access through the bottom of the enclosure 210 and of the mounting assembly 14, with the cover plate 170 lowered or disengaged from the mounting assembly.

FIGS. 31–36 show a custom installation for use in either new construction or in remodeling, and where an aperture sized just to receive the end of the focal lens sleeve 22 of a light projector 12 included in the installation is the only opening left in the ceiling. The housing of the installation includes a square, aluminum enclosure 226 having a removable top 228 that is held on by screws 230. A round hole 231 breaks the bottom of the enclosure 226. Multiple brackets 162 are adjustable by sliding in sleeves 164 attached to the sides of the enclosure 226. The enclosure 226 is positioned above the ceiling among beams or the like, and the brackets 162 are adjusted so that they may be fixed to beams by nails or screws passing through holes 165 in the ends of the brackets to anchor the housing. A recess 166 is provided in the enclosure 226, with an electrical receptacle 167 located in the back of the recess. The enclosure is positioned and mounted among the ceiling beams or the like so as to accommodate the recess 166, protruding from the side of the enclosure. The recess 166 provides room to receive the back end of the light projector 12 in various orientations of the projector. The electrical lead line 62 from the projector lamp 46 (FIG. 3) is covered in heat insulation and connected to a plug (as seen in FIGS. 23, 28 and 30), which is received by the receptacle 167.

A mounting assembly frame 106, having a flange 110A and two retainer walls 112 and 114, as seen in FIGS. 19–22, is positioned within the enclosure 226. Nuts and washers 184 are tightened down on bolts 186 passing through the bottom of the enclosure 226 to hold the flange 110A fixed in a selected orientation within the enclosure. A metal strap 234, having multiple perforations 236, extends between the retainer walls 112 and 114, to which the strap is joined. For example, one end of the strap 234 may be anchored to the retainer wall 112 by using wing bolts 238 passing through holes 236 in the strap and threaded into the bushings 136*a* and 138*a*, and the other end of the strap may be anchored to the retaining wall 114 by wing bolts 240 passing through holes in the strap and threaded into the bushings 136*b* and 138*b*. The strap 234 passes over the light projector 12, and is joined to the light projector by a wing bolt 242 passing through a strap hole 236 and threaded into a hole 33 in the main housing body 18 of the light projector. The light projector 12 is oriented in a desired position within the enclosure 226, and held in place, in part, by the strap 234 being manipulated and tightened accordingly. Other combinations of the retaining wall bushings 132*a*–138*a* and 132*b*–138*b* may be used to anchor the ends of the strap 234, and a longer or shorter strap may be used, as appropriate to achieve the desired orientation of the light projector 12. Plaster of paris 243 is formed around the forward end of the light projector 12 at the bottom of the enclosure 226 to solidify the positioning and anchoring of the light projector. As a result, the light projector 12 is anchored and supported in place by a three-point attachment.

Figure 36:
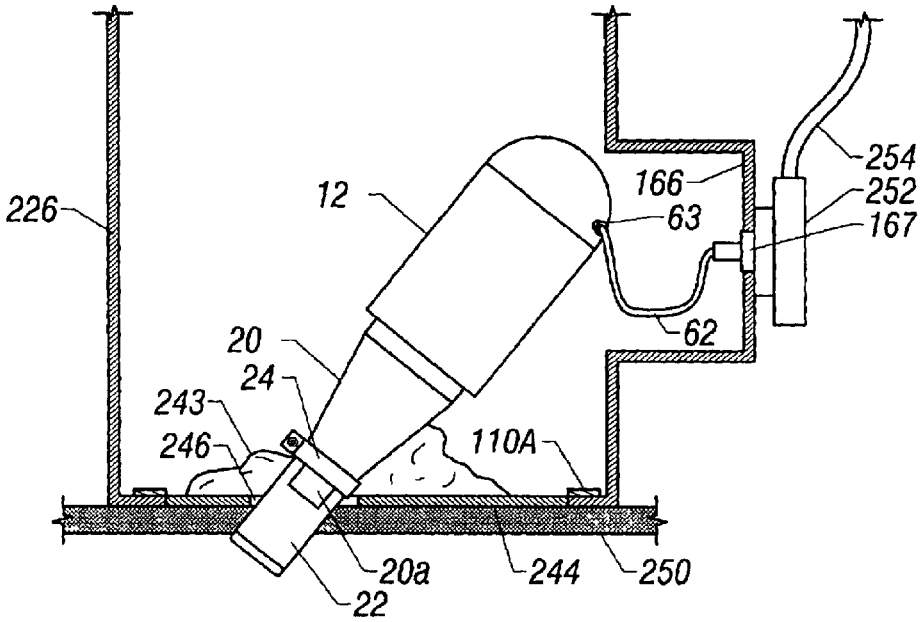
FIG. 36 is a fragmentary side elevation, in partial section, of the installed lighting system of FIGS. 18, 30 and 31.

A heat guard 244 in the form of a metal disk is positioned within the bottom hole 231 of the enclosure 226. The heat guard 244 provides an oblong hole 246 for receiving the focal lens sleeve 22 of the light projector 12 throughout a range of tilt angles, and the heat guard is rotatable within the enclosure bottom hole 231 to accommodate the light projector oriented in any vertical plane. The heat guard 244 also provides a central, round hole 248 to receive the focal lens sleeve 22 when the light projector 12 is oriented vertically, or nearly vertically. The heat guard holes 246 and 248 are formed by punching out knock-outs provided in the heat guard 244, as indicated by dashed lines in FIG. 34, as needed, leaving one or the other of the knock-outs intact. In the completed installation, ceiling material, such as dry wall, 250 is installed below the enclosure 226 and the heat guard 244 to support the heat guard and to finish the ceiling, as seen in FIG. 36. The heat guard 244 serves to reduce any heat generated by the light projector 12 in operation that might otherwise reach the ceiling material 250. Only the end of the focal lens sleeve 22 is visible below the ceiling material 250 in the completed installation.

Use of the space within the enclosure 226 that is provided by the recess 166 to accommodate the light projector 12 in various orientations is illustrated in FIG. 36, wherein the back end of the light projector is shown protruding into the recess. The external connection box 252, discussed above in connection with the enclosures shown in FIGS. 23, 24 and 28–31, is shown joined to the back of the recess 166. An electrical lead 254 extends from the connection box toward a source of electrical power to operate the light projector 12. The electrical connection box 252 is joined to the receptacle 167, which receives the heat-insulated projector lamp electrical lead 62.

After installation of the enclosure 226, the only access to the light projector 12 within is from above the ceiling, through the top of the enclosure with the top 228 removed. Thus, with shutter blades used in the light projector 12 as a mask device, as indicated in FIG. 31 by the presence of the shutter blade tabs 66*a*–72*b*, advantages of the shutter blades of the present invention are clear. First, the light projector 12 sits on the bottom of the housing 226, which would make use of a shutter blade with a tab protruding from the bottom of the light projector impracticable, if not impossible.

Secondly, since access to the light projector 12 is available only from above, adjustment of a shutter blade tab protruding from the bottom of the light projector would again be impracticable, if not impossible. The laterally extending tabs 72*a* and 72*b* of the bottom shutter blade 72 in FIG. 31 makes the use of a bottom shutter blade, and the adjustment of such a shutter blade, possible and workable.

The light projector 12 may be oriented in a variety of directions within the enclosure 226, including pointing vertically downwardly. Such varied orientations of the light projector 12 are achieved by adjusting the length of the strap 234 between the retainer walls 112 and 114, and bending the strap as needed to position the light projector as desired. The plaster of paris 243 completes the anchoring of the light projector 12.

Figure 34:
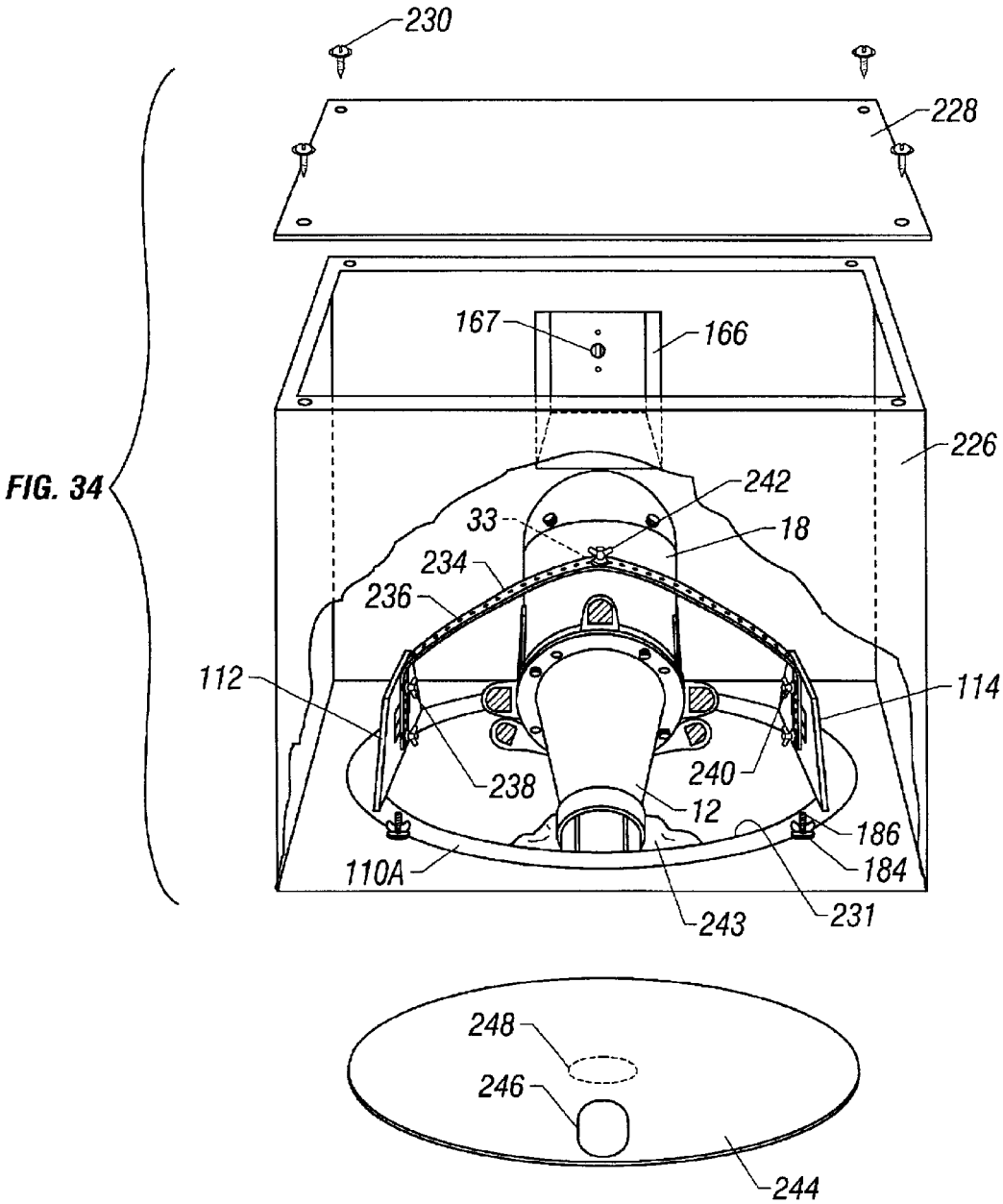
FIG. 34 is an exploded isometric view of a custom lighting system for installation in new or existing construction according to the present invention.
Figure 35:
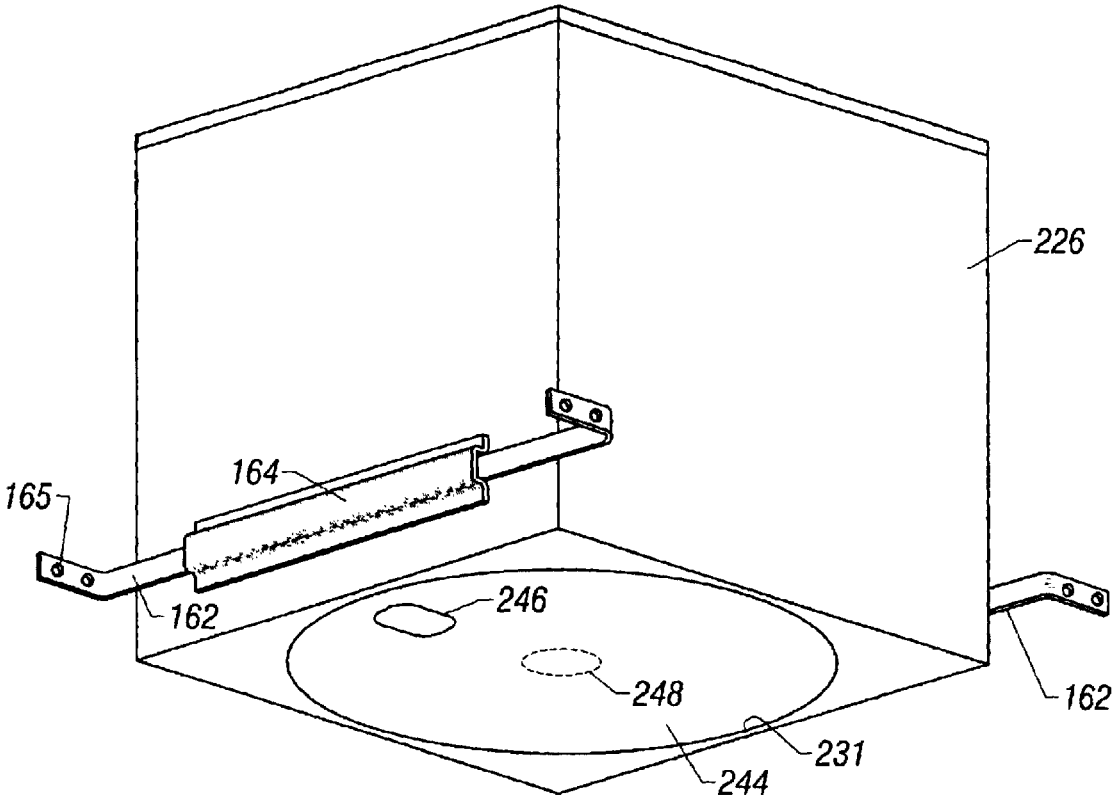
FIG. 35 is an isometric view of the exterior of the lighting system of FIG. 34.

The lighting system installations of FIGS. 23–29 provide the capability of aiming the light projector 12 in any vertical plane by selectively orienting the mounting assembly 14A in the desired direction within the enclosure 152 or 190. The orientation of the mounting assembly 14 to aim the light projector 12 in any vertical plane in the installation of FIGS. 30–33 is achieved by selectively orienting the enclosure 210 relative to the ceiling 216. The orientation of a light projector 12 in any vertical plane in the installation of FIGS. 34–36 is performed by placing the elliptical light projection hole 244, and the mounting frame 106, so as to receive the light projector in the desired direction. The strap 234 may also be bent to assist in aiming the light projector 12 from side to side as well as up and down. The installations of FIGS. 23–29 also include the capability of orienting the light projector 12 in a wide range of directions within the selected vertical plane, using the dual pivot system of the mounting assembly 14 or 14A. The orientation of the light projector 12 in the installation of FIGS. 34–36 in a selected vertical plane is achieved by bending, and adjusting the length of, the strap 240 to raise or lower the rear of the light projector. In all installations of FIGS. 23–36, the light projector 12 may be oriented to project a light beam vertically downwardly.

The present invention thus provides improved contour lighting systems, including an improved shutter blade mask and an improved photo mask. A diffusing filter is provided for the light projector to reduce direct, high intensity light in the center of the light beam from the light projector lamp. An optical bench and clamps are provided to mount optical devices within the light projector. A new mounting assembly features a dual pivot system that increases the orientations available for a light projector using a single mounting device. New housings provide installations in new constructions, or remodeling of completed constructions, with enhanced ability to aim a light projector from an installation enclosure, and provide a finished look to the installations.

The foregoing disclosure and description of the invention is illustrative and explanatory thereof, and various changes in the size, shape and materials as well as in the details of the illustrated construction may be made within the scope of the appended claims without departing from the spirit of the invention.

What is claimed is:

1. A lighting system comprising:

a. a housing;

b. a mounting assembly that is received by the housing and which comprises a frame having an annular flange and two retainer walls extending perpendicularly to the plane of the flange and parallel to each other on opposite sides of the opening defined by the flange;

c. a contour light projector that is mounted on the mounting assembly; and d. a light beam contour mask that is received by the projector.

2. A lighting system as defined in claim 1 wherein the light projector further comprises:

a. a housing assembly;

b. a lamp;

c. a condensing lens;

d. an optical bench mounted within the housing, and which comprises an elongate base to which at least one clamp is attached to hold the lamp and the condensing lens; and e. an objective lens.

3. A lighting system as defined in claim 1 wherein the mask comprises a plurality of shutter blades arrayed about the central axis of a holding ring as part of the light projector and held between the ring and a seating surface as part of the light projector such that the blades may be selectively manipulated between the ring and the seating surface to determine a contour for a light beam produced by the projector, wherein each blade has a concave edge toward the central axis of the holding ring, and wherein each blade has a tab, and one blade has two tabs extending laterally in opposite directions from that blade, such that the blades may be manipulated by the tabs to effect the contour of the light beam.

4. A lighting system as defined in claim 1 wherein the mask comprises a glass plate having affixed thereto a photosensitized tape that is exposed to light and developed, and in which tape an opening is made to determine a contour for a light beam produced by the projector.

5. A lighting system as defined in claim 1 wherein the frame may be rotated in the plane, defined by the flange, relative to the housing.

6. A lighting system as defined in claim 1 wherein the mounting assembly further comprises:

a. a saddle including a cross member and two end walls extending perpendicularly to the cross member and parallel to each other at opposite ends of the cross member, and a curved seat at the middle of the cross member on which the light projector may be selectively positioned and fixed to the saddle; and b. a dual pivot system, as parts of the retainer walls and the end walls, providing two pivot axes whereby the saddle may pivot in a first arc about a first pivot axis relative to the frame and may pivot in a second arc about a second pivot axis relative to the frame.

7. A lighting system as defined in claim 6 further comprising:

a. the housing comprising an enclosure having sides, a removable top, and a bottom that is broken by a hole;

b. a plate, including a light projection hole to receive the end of the light projector for projection of a light beam out of the housing; and c. spring hangers by which the plate is suspended from the mounting assembly and held against the bottom of the enclosure to cover the hole in the bottom of the enclosure.

8. A lighting system as defined in claim 7 wherein the housing further comprises a panel which is joined to the bottom of the enclosure, and which has a hole that aligns generally with the bottom hole of the enclosure and receives the plate when the plate is held against the bottom of the enclosure, and which panel can be floated with adjoining ceiling surface to form a continuation of the finished ceiling.

9. A lighting system as defined in claim 6 further comprising:

a. the housing comprising a round-sided enclosure having a top and an open bottom;

b. multiple retaining clips, with each clip providing a horizontal plate passing through a slot in the side of the housing above the top of a ceiling to support the housing by the ceiling, a vertical plate extending along the inside of the housing by which the clip is joined to the housing side by a connector, and a guide pin extending downwardly;

c. the mounting assembly annular flange being broken by guide holes which receive the guide pins as aids in positioning the mounting assembly relative to the enclosure, and holes through which screws are passed to threadedly connect to the horizontal plates of the retaining clips to anchor the housing to the ceiling;

d. a plate including a light projection hole in the housing to receive the end of the light projector for projection of a light beam out of the housing; and e. spring hangers by which the plate is suspended from the mounting assembly and held against the bottom of the enclosure to cover the bottom of the enclosure.

10. A lighting system as defined in claim 1 further comprising:

a. the housing comprising an enclosure having sides, a removable top, a bottom that is broken by a hole, and a heat guard that is rotatable within the bottom hole and which provides a light projection hole for projection of a light beam out of the housing; and b. a strap connected to the light projector and to the two retaining walls to hold the light projector with the end of the light projector positioned in the light projection hole.

11. A contour light projector comprising:

a. a housing assembly;

b. a lamp;

c. a condensing lens;

d. an optical bench mounted within the housing, and which comprises an elongate base to which at least one clamp is attached to hold the lamp and the condensing lens;

e. a light beam contour mask; and f. an objective lens.

12. A contour light projector as defined in claim 11 further comprising:

a. the elongate base having a flat surface; and b. one or more clamps, with each clamp comprising a strip folded to form at least five planes with a set of openings arrayed in at least the two end planes, and with the clamp attached to the flat surface of the base at the central plane of the clamp, whereby the array of openings is in a plane perpendicular to the longitudinal axis of the base;

c. whereby a lens and the lamp may each be received by an array of slots in a clamp and thereby held to the optical bench.

13. A contour light projector as defined in claim 12 further comprising at least one clamp having multiple arrays of openings located at different locations along the longitudinal axis of the base.

14. A contour light projector as defined in claim 12 wherein the base of the optical bench has multiple flat surfaces in parallel planes at different lateral distances from the longitudinal axis of the base, and to which flat surfaces clamps may be attached.

15. A contour light projector as defined in claim 11 further comprising a diffusing filter positioned between the lamp and the condensing lens.

16. A mounting assembly for receiving and holding a light projector, comprising the following:

a. a frame including an annular flange and two retainer walls extending perpendicularly to the plane of the flange and parallel to each other on opposite sides of the opening defined by the flange;

b. a saddle including a cross member and two end walls extending perpendicularly to the cross member and parallel to each other at opposite ends of the cross member, and a curved seat at the middle of the cross member on which the light projector may be selectively positioned and fixed to the saddle; and c. a dual pivot system, as parts of the retainer walls and the end walls, providing two pivot axes whereby the saddle may pivot in a first arc about a first pivot axis relative to the frame and may pivot in a second arc about a second pivot axis relative to the frame.

17. A mounting assembly as defined in claim 16 further comprising multiple slots along the seat for receiving a bolt that is threaded into the light projector whereby the light projector may be anchored at selected positions along the seat.

18. A mounting assembly as defined in claim 16 wherein the dual pivot system comprises:

a. two pivot receptacles spaced apart in each retainer wall and two guide receptacles spaced apart in each retainer wall;

b. a pivot hole and an arcuate guide slot in each of the two end walls;

c. two pivot members and two guide members;

d. each pivot member passing through the pivot hole of an end wall and one of the two pivot receptacles of a retainer wall, with the two pivot members determining a pivot axis, whereby the saddle may pivot about the pivot axis thus determined by the positions of the two pivot members; and e. each guide member passing through a guide slot in an end wall and one of the two guide receptacles of a retainer wall whereby the pivoting of the saddle is constrained by the movement of the guide slots along the guide receptacles.

19. A mounting assembly as defined in claim 18 further comprising the guide members selectively locked in the guide receptacles to hold the saddle fixed against pivoting movement relative to the frame.

20. A contour light projector mask comprising a plurality of shutter blades arrayed about the central axis of a holding ring of the light projector and held between the ring and a seating surface of the light projector such that the blades may be selectively manipulated between the ring and the seating surface to determine a contour for a light beam produced by the projector, wherein each blade has a concave edge toward the central axis of the holding ring, and wherein each blade has a tab, and one blade has two tabs extending laterally in opposite directions from that blade, such that the blades may be manipulated by the tabs to effect the contour of the light beam.

21. A contour light projector mask comprising a glass plate having affixed thereto a photosensitized tape that is exposed to light and developed, and in which tape an opening is made to determine a contour for a light beam produced by the projector.

* * * * *

Disclaimer

6,832,845 B1 — Thomas E. Kretzschmar, Bellaire, TX (US); Gilbert Thomas Pistole, Katy, TX (US). CONTOUR LIGHT PROJECTOR. Patent dated December 21, 2004. Disclaimer filed June 22, 2012, by the inventors.

Hereby disclaims complete claims 1 and 5 of said patent.

(*Official Gazette, July 31, 2012*)

Disclaimer

6,832,845 B1—Thomas E. Kretzschmar, Bellaire, TX (US); Gilbert Thomas Pistole, Katy, TX (US). CONTOUR LIGHT PROJECTOR. Patent dated December 21, 2004. Disclaimer filed June 22, 2012, by the assignee, Thomas E. Kretzschmar.

Hereby disclaims complete claims 1 and 5 of said patent.

(*Official Gazette, October 23, 2012*)